US011704967B2

(12) United States Patent
Santisi

(10) Patent No.: US 11,704,967 B2
(45) **Date of Patent: *Jul. 18, 2023**

(54) GAMING MACHINE WITH CURRENT THEORETICAL RETURN-TO-PLAYER DISPLAY AND DYNAMIC ADJUSTMENT OF SAME

(71) Applicant: Aristocrat Technologies Australia Pty Limted, North Ryde (AU)

(72) Inventor: Steven M. Santisi, Las Vegas, NV (US)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 0 days.

This patent is subject to a terminal disclaimer.

(21) Appl. No.: 17/446,355

(22) Filed: Aug. 30, 2021

(65) Prior Publication Data

US 2021/0390826 A1 Dec. 16, 2021

Related U.S. Application Data

(63) Continuation of application No. 16/022,616, filed on Jun. 28, 2018, now Pat. No. 11,107,319.

(51) Int. Cl.
*G07F 17/32* (2006.01)

(52) U.S. Cl.
CPC ..... *G07F 17/3244* (2013.01); *G07F 17/3227* (2013.01)

(58) Field of Classification Search
CPC ..... G07F 17/3244; G07F 17/3227
USPC ..... 463/25
See application file for complete search history.

(56) References Cited

U.S. PATENT DOCUMENTS

| | | | |
|---|---|---|---|
| 8,992,306 | B2 | 3/2015 | Iddings |
| 9,084,932 | B2 | 7/2015 | Gadher |
| 9,659,442 | B2 | 5/2017 | Acres |
| 9,666,025 | B2 | 5/2017 | Walker |
| 2007/0060252 | A1 | 3/2007 | Taylor |
| 2010/0029381 | A1 | 2/2010 | Vancura |

(Continued)

OTHER PUBLICATIONS

Response to Freedom of Information Action Request, dated Jan. 28, 2015, 1 pg.

(Continued)

*Primary Examiner* — Jay Trent Liddle
*Assistant Examiner* — Ryan Hsu
(74) *Attorney, Agent, or Firm* — Weaver Austin Villeneuve & Sampson LLP

(57) ABSTRACT

Gaming machines or systems that provide for display of a current theoretical return-to-player (CTRTP) characteristic to the player during play of a game of chance are provided. Such gaming machines may also provide the player with opportunities (and notifications thereof) to increase the CTRTP characteristic by satisfying one or more CTRTP increase conditions associated with a credit wagering rate of the player on the gaming machine that the player is playing. Some such gaming machines may have automated wagering functionality in which the gaming machine may automatically place wagers for the player as long as certain conditions are met. In such gaming machines, the player may be able to control or influence the automatic wagering behavior of the gaming machine through the use of a rate selector that allows the player to change the wagering frequency and/or the wager amount used to place the automatic wagers.

20 Claims, 9 Drawing Sheets

(56) References Cited

U.S. PATENT DOCUMENTS

| | | | |
|---|---|---|---|
| 2012/0184353 | A1 | 7/2012 | Anderson |
| 2017/0228977 | A1 | 8/2017 | Acres |

OTHER PUBLICATIONS

"Remote gambling and software technical standards," Gaming Commission, Jun. 2017, 38 pgs.
"Betting, Gaming and Lotteries," The Gaming Machine (Circumstances of Use) Regulations 2007, 12 pgs.
Office Action dated Jul. 28, 2020 for U.S. Appl. No. 16/022,616 (pp. 1-15).
Office Action dated Jan. 19, 2021 for U.S. Appl. No. 16/022,616 (pp. 1-11).
Notice of Allowance dated Apr. 29, 2021 for U.S. Appl. No. 16/022,616 (pp. 1-9).

GAMING MACHINE WITH CURRENT THEORETICAL RETURN-TO-PLAYER DISPLAY AND DYNAMIC ADJUSTMENT OF SAME

CROSS-REFERENCE TO RELATED APPLICATIONS

This application is a continuation under 35 U.S.C. § 120 of U.S. patent application Ser. No. 16/022,616, filed Jun. 28, 2018, and titled "GAMING MACHINE WITH CURRENT THEORETICAL RETURN-TO-PLAYER DISPLAY AND DYNAMIC ADJUSTMENT OF SAME," which is hereby incorporated herein by reference in its entirety and for all purposes.

BACKGROUND

Electronic gaming machines ("EGMs") or gaming devices provide a variety of wagering games such as slot games, video poker games, video blackjack games, roulette games, video bingo games, keno games and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In many games, a player may qualify for secondary games or bonus rounds by attaining a certain winning combination or triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player (RTP =return to player) over the course of many plays or instances of the game. The RTP and randomness of the RNG are critical to ensuring the fairness of the games and are therefore highly regulated. Upon initiation of play, the RNG randomly determines a game outcome and symbols are then selected which correspond to that outcome. Notably, some games may include an element of skill on the part of the player and are therefore not entirely random.

SUMMARY

Gaming machines or systems are described that provide for display of a current theoretical return-to-player (CTRTP) characteristic to the player during play of a game of chance. Such gaming machines may also provide the player with opportunities (and notifications thereof) to increase the CTRTP characteristic by satisfying one or more CTRTP increase conditions associated with a credit wagering rate of the player on the gaming machine that the player is playing. If the player satisfies the CTRTP increase condition(s) associated with a particular opportunity, the gaming machine may modify one or more settings in a way that causes the CTRTP characteristic of the gaming machine to increase by some amount.

In some implementations of such gaming machines, the gaming machine may have automated wagering functionality in which the gaming machine may automatically place wagers for the player as long as certain conditions are met. In such gaming machines, the player may be able to control or influence the automatic wagering behavior of the gaming machine through the use of a rate selector that allows the player to change the wagering frequency and/or the wager amount used to place the automatic wagers. In some such implementations, the gaming machine may also provide graphical feedback that is tied to the inputs provided to the rate selector; such graphical feedback may present an animated graphical environment that may show different content depending on the nature of the input received from the rate selector.

In some instances, gaming machines such as those described herein may allow a player to transfer the CTRTP characteristic enhancements that they have earned to another player. In some such cases, the player may be able to exchange such increased CTRTP characteristics in return for monetary compensation from the follow-on player.

In some implementations, an electronic gaming system may be provided that includes one or more displays associated with a first gaming machine. The electronic gaming system may also include a game controller that includes one or more processors and one or more memory devices; the one or more processors, the one or more memory devices, and the one or more displays may be operably connected and the one or more memory devices may store computer-executable instructions for controlling the one or more processors to: cause a game of chance having a current theoretical return-to-player (CTRTP) characteristic that is defined by one or more settings associated with the first gaming machine to be displayed on the one or more displays of the first gaming machine; accept credit wagers on the game of chance from a first player; cause an indicator of the CTRTP characteristic to be displayed on the one or more displays concurrently with the display of the game of chance on the one or more displays; and provide, during the game of chance, one or more notifications to the first player of the first gaming machine, each notification notifying the first player of a corresponding opportunity to increase the CTRTP characteristic of the first gaming machine, each opportunity to increase the CTRTP characteristic of the first gaming machine requiring satisfaction of a corresponding one or more CTRTP increase conditions associated with a credit wagering rate of the first player on the first gaming machine. In such implementations, each notification to the first player may include an indication of an amount that the CTRTP characteristic will be increased by in association with the corresponding opportunity. The one or more memory devices may store further computer-executable instructions for additionally controlling the one or more processors to: monitor the credit wagering rate of the first player of the first gaming machine while playing the game of chance; adjust the one or more settings associated with the first gaming machine to increase the CTRTP characteristic each time the first player satisfies the one or more CTRTP increase conditions corresponding to one of the opportunities; and adjust, responsive to each increase of the CTRTP characteristic, the indicator of the CTRTP characteristic displayed on the one or more displays to indicate the increased CTRTP characteristic.

7In some implementations of the system, the indication of the amount that the CTRTP characteristic will be increased by may be an indication of a value that the CTRTP will be after the increase.

In some implementations of the system, the one or more memory devices may further store computer-executable instructions for further controlling the one or more processors to: periodically determine a session return-to-player (SRTP) for the first player for a first gaming session involving play of the game of chance by the first player and cause an indicator of the SRTP to be displayed on the one or more displays during the display of the game of chance on the one or more displays.

In some implementations of the system, the one or more memory devices may further store computer-executable instructions for further controlling the one or more processors to provide at least two or more of the notifications, each requiring the satisfaction of a different set of one or more CTRTP increase conditions, concurrently.

In some implementations of the system, the system may further include one or more user experience devices that are also associated with the first gaming machine and the one or more memory devices may further store computer-executable instructions for further controlling the one or more processors to activate at least one of the one or more the user experience devices at a first intensity level responsive to an increase of the CTRTP characteristic. The user experience devices associated with the first gaming machine may, for example, be one or more devices or combinations of devices such as audio devices, illumination devices, vibratory feedback devices, smoke or fog generators, motors, and actuators In some implementations of the system, the system may further include a first automatic wagering sensor and a first rate selector that are also associated with the first gaming machine, and the one or more memory devices may further store computer-executable instructions for further controlling the one or more processors to: receive first data from the first automatic wagering sensor; receive second data from the first rate selector; cause the first gaming machine to periodically wager credits in the game of chance at a first credit wagering rate while the first data from the first automatic wagering sensor meets a first automatic wagering condition; and modify the first credit wagering rate based on the second data.

In some such implementations of the system, the first rate selector may be configured to generate, responsive to user input, one or more signals such as a signal indicating a change in wagering frequency, a signal indicating a change in wager amount, and signals indicating a change in wagering frequency and a change in wager amount.

In some implementations of the system, the one or more memory devices may further store computer-executable instructions for further controlling the one or more processors to: cause graphical content to be displayed on the one or more displays showing progression through an environment along a substantially predefined path in which the path periodically includes branch points, each branch point having a plurality of branches and each branch associated with a corresponding selectable rate; determine, for each branch point and in response to the second data, which branch of each branch point is indicated by the second data as being selected; modify the first credit wagering rate based on the second data by modifying the first credit wagering rate based on the corresponding selectable rate for each branch that is indicated by the second data as being selected; and cause the graphical content displayed on the one or more displays to vary depending on which branch is indicated by the second data as being selected.

In some implementations of the system, the first rate selector may include an emergency brake feature and the one or more memory devices may further store computer-executable instructions for further controlling the one or more processors to: reduce the first credit wagering rate responsive to the second data indicating that the emergency brake feature has been activated.

In some implementations of the system, the one or more memory devices may further store computer-executable instructions for further controlling the one or more processors to: cause graphical content to be displayed on the one or more displays showing a first-person point-of-view progression moving through an environment substantially along a path with a plurality of targets arranged substantially along the path, and cause the first-person point-of-view to move along an axis transverse to the path responsive to the second data during progression of the first-person point-of-view through the environment, in which at least one of the one or more CTRTP increase conditions is satisfied when the first-person point-of-view is caused to move, responsive to the second data, such that the first-person point-of-view substantially aligns with a predetermined number of targets during progression of the first-person point-of-view through the environment.

In some implementations of the system, the one or more memory devices may further store computer-executable instructions for further controlling the one or more processors to: cause graphical content to be displayed on the one or more displays showing movement of a graphical depiction of an environment relative to the one or more displays, the environment containing a plurality of targets that are sequentially displayed on the one or more displays during the movement of the graphical depiction of the environment relative to the one or more displays; cause a graphical object to be displayed on the one or more displays while the graphical content is displayed; and cause the graphical object to move along an axis transverse to a direction of movement of the graphical depiction responsive to the second data, in which at least one of the one or more CTRTP increase conditions is satisfied when the graphical object is caused to move, responsive to the second data, such that the graphical object passes through a predetermined number of the targets during movement of the graphical depiction.

In some implementations of the system, the one or more memory devices may further store computer-executable instructions for further controlling the one or more processors to: receive one or more request signals, each request signal associated with a different player of a corresponding one or more other players different from the first player; receive a player input signal associated with conclusion of a first gaming session of the first player on the first gaming machine; determine, responsive to receiving the player input signal, whether a second player of the one or more other players satisfies one or more transfer conditions; allocate, responsive to determining that the second player satisfies the one or more transfer conditions, the first gaming machine to the second player; and cause the one or more settings of the first gaming machine, and thus the CTRTP characteristic, to be preserved for the second player after conclusion of the first gaming session of the first player on the first gaming machine and in association with initiation of a second gaming session on the first gaming machine and associated with the second player.

In some implementations of the system, the one or more memory devices may further store computer-executable instructions for further controlling the one or more processors to: receive bidding information from each of the one more other players; determine that the second player has a winning bid based on the bidding information; and determine that the one or more transfer conditions are satisfied, at least in part, by the determination that the second player has the winning bid.

In some implementations of the system, each request signal may be associated with a corresponding timestamp and the one or more transfer conditions may be satisfied, at least in part, when the corresponding timestamps of the request signals indicate that the second player has been waiting the longest of the one or more other players to be allocated a gaming machine such as the first gaming machine or one or more other gaming machines that each provide a game of chance that has a player-increasable CTRTP characteristic.

In some implementations of the system, the request signal associated with the second player may be associated with one or more filter conditions specified by the second player, and the one or more memory devices may further store computer-executable instructions for further controlling the one or more processors to determine that the first gaming machine meets the filter conditions prior to allocating the first gaming machine to the second player.

In some implementations of the system, the one or more transfer conditions may be satisfied when input is received from the second player that indicates that the second player agrees to pay a specified amount of money or credits to the first player, and the one or more memory devices may further store computer-executable instructions for further controlling the one or more processors to cause the specified amount of money or credits to be transferred to the first player from a source associated with the second player.

In some implementations of the system, the one or more transfer conditions may be satisfied when input is received from the second player that indicates that the second player agrees to pay a specified portion of one or more winnings that the second player is awarded during the second gaming session, and the one or more memory devices may further store computer-executable instructions for further controlling the one or more processors to cause the specified portion of the one or more winnings that the second player is awarded during the second session to be transferred to the first player from a source associated with the second player.

In some implementations, a method of providing a game of chance on an electronic gaming system is provided that includes causing a game of chance to be displayed on one or more displays of a first gaming machine. The game of chance may have a current theoretical return-to-player (CTRTP) characteristic that is defined by one or more settings associated with the first gaming machine, and the method may further include receiving indications of credit wagers on the game of chance by a first player; causing an indicator of the CTRTP characteristic to be displayed on the one or more displays concurrently with the display of the game of chance on the one or more displays; and causing, during the game of chance, one or more notifications to be provided to the first player of the first gaming machine, each notification notifying the first player of a corresponding opportunity to increase the CTRTP characteristic of the first gaming machine. Each opportunity to increase the CTRTP characteristic of the first gaming machine may require satisfaction of a corresponding one or more CTRTP increase conditions associated with a credit wagering rate of the first player on the first gaming machine, and each notification to the first player may include an indication of an amount that the CTRTP characteristic will be increased by in association with the corresponding opportunity. The method may further include causing the credit wagering rate of the first player of the first gaming machine while playing the game of chance to be monitored; causing the one or more settings associated with the first gaming machine to be adjusted to increase the CTRTP characteristic each time the first player satisfies the one or more CTRTP increase conditions corresponding to one of the opportunities; and causing, responsive to each increase of the CTRTP characteristic, the indicator of the CTRTP characteristic displayed on the one or more displays to be adjusted to indicate the increased CTRTP characteristic.

In some implementations, a non-transitory, computer-readable medium storing machine-readable and executable instructions for controlling one or more processors of an electronic gaming system may be provided. The machine-executable instructions may cause one or more processors of an electronic gaming system to cause a game of chance to be displayed on one or more displays of a first gaming machine. The game of chance may have a current theoretical return-to-player (CTRTP) characteristic that is defined by one or more settings associated with the first gaming machine. The machine-executable instructions may further cause the one or more processors of the electronic gaming system to receive indications of credit wagers on the game of chance by a first player; cause an indicator of the CTRTP characteristic to be displayed on the one or more displays concurrently with the display of the game of chance on the one or more displays; and cause, during the game of chance, one or more notifications to be provided to the first player of the first gaming machine. Each notification may notify the first player of a corresponding opportunity to increase the CTRTP characteristic of the first gaming machine, and each opportunity to increase the CTRTP characteristic of the first gaming machine may require satisfaction of a corresponding one or more CTRTP increase conditions associated with a credit wagering rate of the first player on the first gaming machine. Each notification to the first player may include an indication of an amount that the CTRTP characteristic will be increased by in association with the corresponding opportunity. The machine-executable instructions may further cause the one or more processors of the electronic gaming system to cause the credit wagering rate of the first player of the first gaming machine while playing the game of chance to be monitored; cause the one or more settings associated with the first gaming machine to be adjusted to increase the CTRTP characteristic each time the first player satisfies the one or more CTRTP increase conditions corresponding to one of the opportunities; and cause, responsive to each increase of the CTRTP characteristic, the indicator of the CTRTP characteristic displayed on the one or more displays to be adjusted to indicate the increased CTRTP characteristic.

In some such implementations, the non-transitory, computer-readable medium may further store machine-readable and executable instructions for further controlling the one or more processors of the electronic gaming system to cause the one or more processors of the electronic gaming system to: cause first data to be received from a first automatic wagering sensor; cause second data to be received from a first rate selector; cause the first gaming machine to periodically wager credits in the game of chance at a first credit wagering rate while the first data from the first automatic wagering sensor meets a first automatic wagering condition; and modify the first credit wagering rate based on the second data.

DETAILED DESCRIPTION

Figure 1:
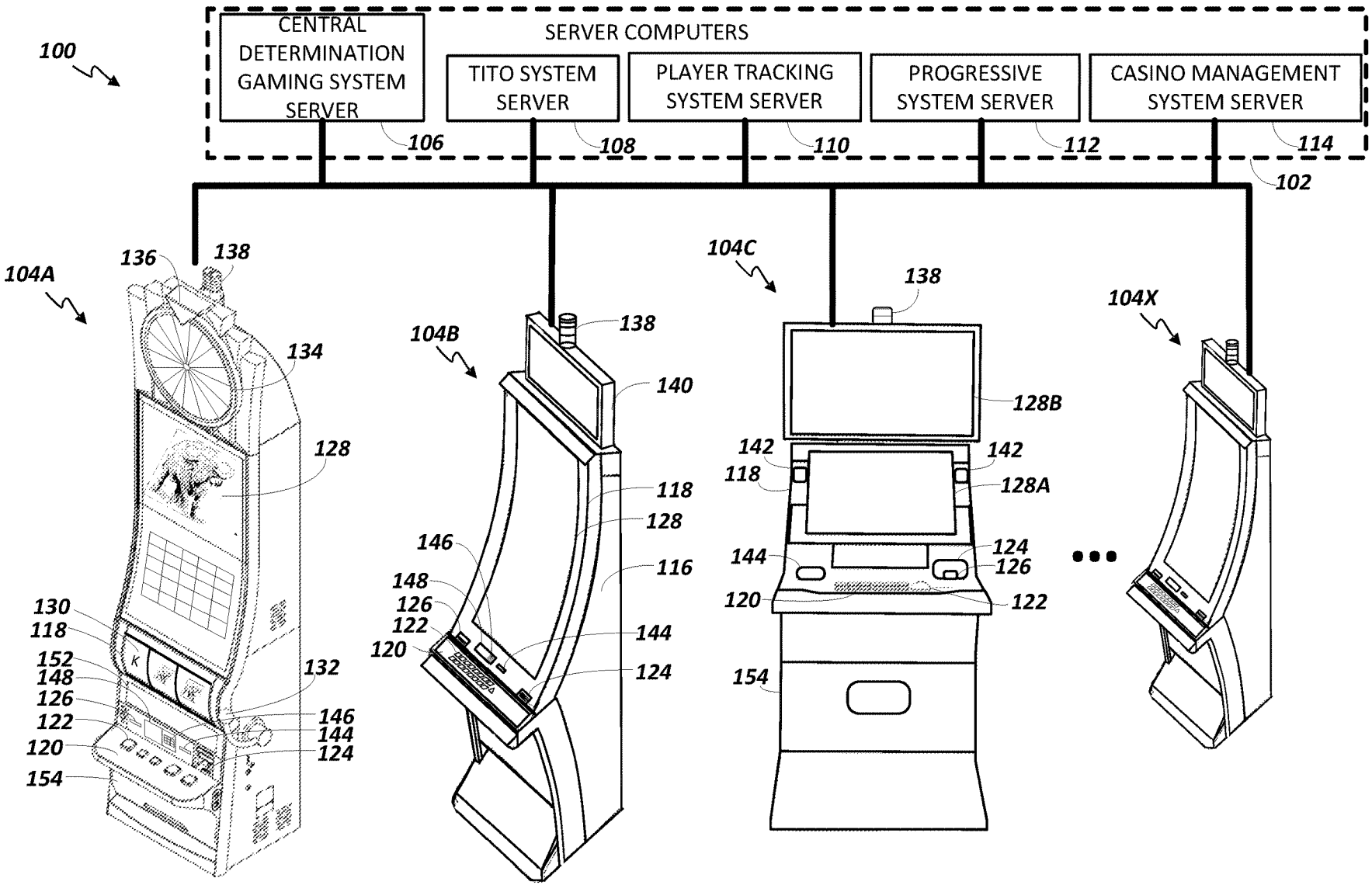
FIG. 1 is an exemplary diagram showing several EGMs networked with various gaming related servers.

FIG. 1 illustrates several different models of EGMs which may be networked to various gaming related servers. The present invention can be configured to work as a system 100 in a gaming environment including one or more server computers 102 (e.g., slot servers of a casino) that are in communication, via a communications network, with one or more gaming devices 104A-104X (EGMs, slots, video poker, bingo machines, etc.). The gaming devices 104A-104X may alternatively be portable and/or remote gaming devices such as, but not limited to, a smart phone, a tablet, a laptop, or a game console, although such devices may require specialized software and/or hardware to comply with regulatory requirements regarding devices used for wagering or games of chance in which monetary awards are provided.

Communication between the gaming devices 104A-104X and the server computers 102, and among the gaming devices 104A-104X, may be direct or indirect, such as over the Internet through a website maintained by a computer on a remote server or over an online data network including commercial online service providers, Internet service providers, private networks, and the like. In other embodiments, the gaming devices 104A-104X may communicate with one another and/or the server computers 102 over RF, cable TV, satellite links and the like.

In some embodiments, server computers 102 may not be necessary and/or preferred. For example, the present invention may, in one or more embodiments, be practiced on a stand-alone gaming device such as gaming device 104A, gaming device 104B or any of the other gaming devices 104C-104X. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door 154 which provides access to the interior of the cabinet. Gaming device 104A typically includes a button area or button deck 120 accessible by a player that is configured with input switches or buttons 122, an access channel for a bill validator 124, and/or an access channel for a ticket printer 126.

In FIG. 1, gaming device 104A is shown as a Relm XL™ model gaming device manufactured by Aristocrat® Technologies, Inc. As shown, gaming device 104A is a reel machine having a gaming display area provided by a main display 128 that may display a number (typically 3 or 5) of mechanical reels 130 with various symbols displayed on them. The reels 130 are independently spun and stopped to show a set of symbols within the gaming display area which may be used to determine an outcome to the game.

In many configurations, the gaming machine 104A may have a main display 128 (e.g., video display monitor) mounted to, or above, the gaming display area. The main display 128 can be a high-resolution LCD, plasma, LED, or OLED panel which may be flat or curved as shown, a cathode ray tube, or other conventional electronically controlled video monitor.

In some embodiments, the bill validator 124 may also function as a "ticket-in" reader that allows the player to use a casino issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are well known in the art and are used to generate and track unique bar-codes or other indicators printed on tickets to allow players to avoid the use of bills and coins by loading credits using a ticket reader and cashing out credits using a ticket-out printer 126 on the gaming device 104A.

In some embodiments, a player tracking card reader 144, a transceiver for wireless communication with a player's smartphone, a keypad 146, and/or an illuminated display 148 for reading, receiving, entering, and/or displaying player tracking information is provided in EGM 104A. In such embodiments, a game controller within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2:
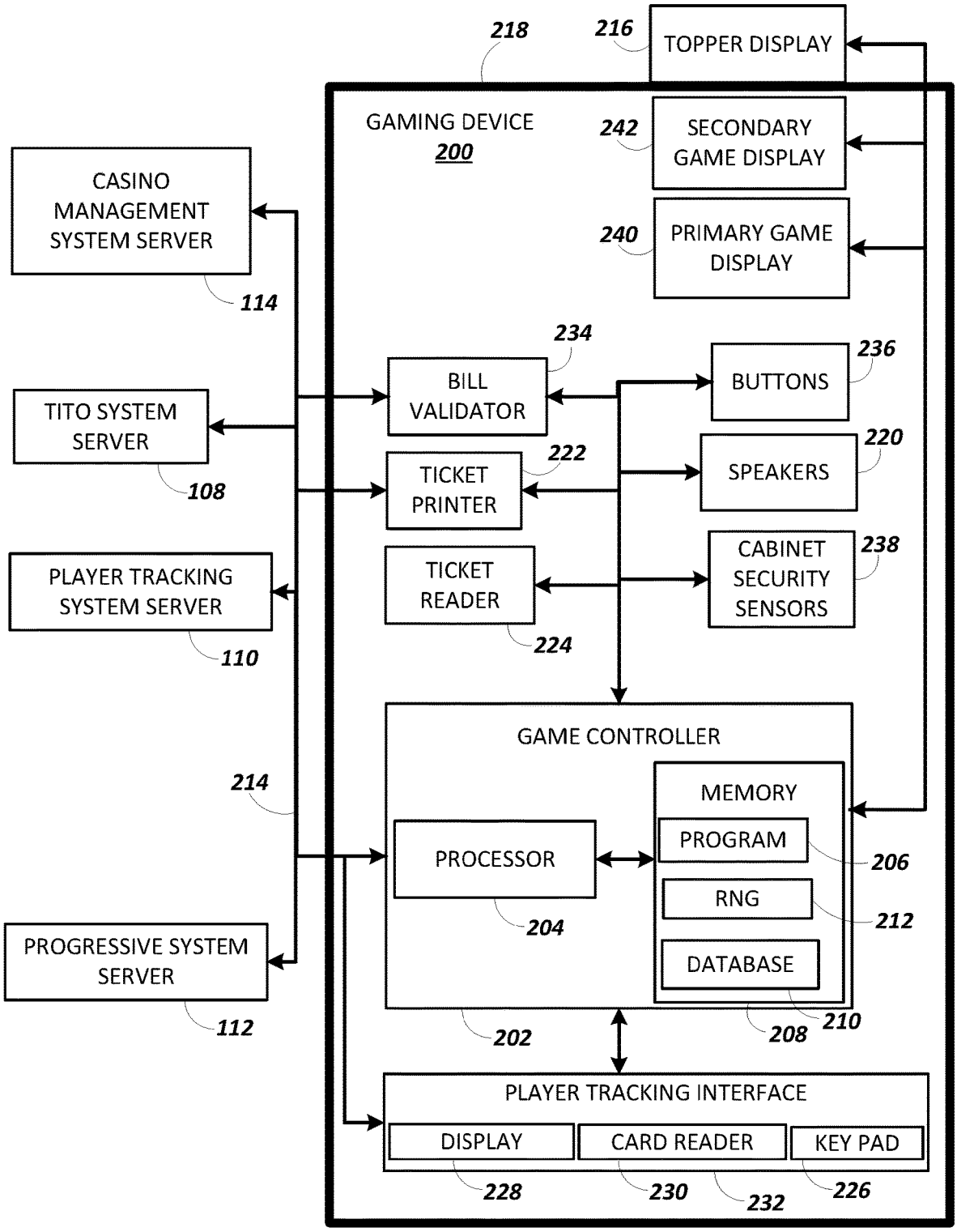
FIG. 2 is a block diagram showing various functional elements of an exemplary EGM.

Many or all the above described components can be controlled by circuitry (e.g., a gaming controller) housed inside the main cabinet 116 of the gaming device 104A, the details of which are shown in FIG. 2.

Note that not all gaming devices suitable for implementing embodiments of the present invention necessarily include top wheels, top boxes, information panels, cashless ticket systems, and/or player tracking systems. Further, some suitable gaming devices have only a single game display that includes only a mechanical set of reels and/or a video display, while others are designed for bar counters or table tops and have displays that face upwards.

An alternative example gaming device 104B illustrated in FIG. 1 is the Arc™ model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door 118 which opens to provide access to the interior of the gaming device 104B. The main or service door 118 is typically used by service personnel to refill the ticket-out printer 126 and collect bills and tickets inserted into the bill validator 124. The door 118 may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape display 128A may have a curvature radius from top to bottom, or alternatively from side to side. In some embodiments, display 128A is a flat panel display. Main display 128A is typically used for primary game play while secondary display 128B is typically used for bonus game play, to show game features or attraction activities while the game is not in play or any other information or media desired by the game designer or operator.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2 is a block diagram depicting exemplary internal electronic components of a gaming device 200 connected to various external systems. All or parts of the example gaming device 200 shown could be used to implement any one of the example gaming devices 104A-X depicted in FIG. 1. The games available for play on the gaming device 200 are controlled by a game controller 202 that includes one or more processors 204 and a game that may be stored as game software or a program 206 in a memory 208 coupled to the processor 204. The memory 208 may include one or more mass storage devices or media that are housed within gaming device 200. Within the mass storage devices and/or memory 208, one or more databases 210 may be provided for use by the program 206. A random number generator (RNG) 212 that can be implemented in hardware and/or software is typically used to generate random numbers that are used in the operation of game play to ensure that game play outcomes are random and meet regulations for a game of chance.

Alternatively, a game instance (i.e. a play or round of the game) may be generated on a remote gaming device such as a central determination gaming system server 106 (not shown in FIG. 2 but see FIG. 1). The game instance is communicated to gaming device 200 via the network 214 and then displayed on gaming device 200. Gaming device 200 may execute game software, such as but not limited to video streaming software that allows the game to be displayed on gaming device 200. When a game is stored on gaming device 200, it may be loaded from a memory 208 (e.g., from a read only memory (ROM)) or from the central determination gaming system server 106 to memory 208. The memory 208 may include RAM, ROM or another form of storage media that stores instructions for execution by the processor 204.

The gaming device 200 may include a topper display 216 or another form of a top box (e.g., a topper wheel, a topper screen, etc.) which sits above main cabinet 218. The gaming cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. The player tracking interface 232 may include a keypad 226 for entering information, a player tracking display 228 for displaying information (e.g., an illuminated or video display), a card reader 230 for receiving data and/or communicating information to and from media or a device such as a smart phone enabling player tracking. Ticket printer 222 may be used to print tickets for a TITO system server 108. The gaming device 200 may further include a bill validator 234, buttons 236 for player input, cabinet security sensors 238 to detect unauthorized opening of the cabinet 218, a primary game display 240, and a secondary game display 242, each coupled to and operable under the control of game controller 202.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

Gaming devices, such as gaming devices 104A-104X, 200, are highly regulated to ensure fairness and, in many cases, gaming devices 104A-104X, 200 are operable to award monetary awards (e.g., typically dispensed in the form of a redeemable voucher). Therefore, to satisfy security and regulatory requirements in a gaming environment, hardware and software architectures are implemented in gaming devices 104A-104X, 200 that differ significantly from those of general-purpose computers. Adapting general purpose computers to function as gaming devices 200 is not simple or straightforward because of: 1) the regulatory requirements for gaming devices 200, 2) the harsh environment in which gaming devices 200 operate, 3) security requirements, 4) fault tolerance requirements, and 5) the requirement for additional special purpose componentry enabling functionality of an EGM. These differences require substantial engineering effort with respect to game design implementation, hardware components and software.

When a player wishes to play the gaming device 200, he/she can insert cash or a ticket voucher through a coin acceptor (not shown) or bill validator 234 to establish a credit balance on the gamine machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views the game outcome on the game displays 240, 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using the player-input buttons 236, the primary game display 240 which may be a touch screen, or using some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

A key performance measure of gaming machines is their "return-to-player" (RTP), which is an approximation or estimate of the percentage of all credits received by a gaming machine that are returned to players over time; it can be thought of as the average percentage of each credit that is returned to a player for each play. RTP is typically determined based on probabilistic outcomes for a particular gaming machine based on a large number of theoretical plays, e.g., for 1000, 10,000, or 100,000 plays. Thus, a player, were they to play a large number of games on that particular gaming machine, would theoretically expect to receive back an amount X of the amount Y of credits that they played; X/Y would be the RTP. The portion of the credits played that is not returned to the player is retained by the gaming machine operator and/or other parties as income or profit.

As with all statistical measures, the RTP is not a measure of guaranteed performance—it is merely predictive and provides a high-level indication of the average percent of each wager that a player will receive back for each play (although each individual play may have a chance of paying anywhere between $0 and a jackpot value that may be tens, hundreds, or thousands time higher than the average (or even higher)). Generally speaking, players view gaming machines with higher RTPs more favorably than lower RTP gaming machines and, given the choice, typically opt to play higher RTP gaming machines over lower RTP gaming machines.

Casinos generally keep the RTPs of gaming machines (which can vary from gaming machine to gaming machine, even between gaming machines that look identical, due to the individual settings of each gaming machine) confidential so that players cannot be certain which gaming machines have higher RTPs. This prevents scenarios in which players concentrate play only on the higher-RTP gaming machines and neglect the lower-RTP gaming machines. In some jurisdictions, regulations may require that each gaming machine display an RTP of that gaming machine; in such cases, the RTP that is displayed is typically representative of the bottom end of a range of potential RTPs that the gaming machine may support (a "worst case scenario" RTP). For example, a casino may have 20 slot machines of the same type and model, but each may be configured with slightly different settings resulting in those 20 slot machines having RTPs that range from 80.9% up to 92.3%; the RTP that is displayed on such machines, e.g., to comply with legal requirements, may be indicative of the bottom end of the range, e.g., 80.9%, or of the range itself, e.g., 80.9% to 92.3%, so as to not provide players with an indication of exactly which of the 20 machines is the "high" performer of the group. Additionally, modern gaming machines that display such RTPs typically display the RTP in response to a user action, such as a user request to see instructions on how to play a particular game of chance—when the user presses a button that causes an instruction screen to be displayed, that instruction screen may also include a statement regarding the RTP, as discussed above. Such gaming machines do not typically display such RTPs during play.

It is to be understood that references to RTP and related concepts, e.g., base RTP, current theoretical RTP, etc., is inclusive of approximations of the RTP in addition to the exact values, e.g., an RTP of 0.8946341 may be represented as an approximation, such as 0.895 or 0.89, and display of such values would still be considered to be viewed as a display of the RTP (even though the actual displayed values have been rounded to fewer decimal points).

As noted above, it may be common for gaming machines to, in some fashion, display a minimum RTP that a gaming machine will provide (or that a gaming machine will at least meet or exceed); such a minimum RTP may be referred to as a base RTP, or BRTP. The BRTP may be established based on regulatory requirements, e.g., a minimum RTP may be required in a particular jurisdiction, gaming machine make/model, e.g., certain gaming machines may have minimum RTPs that they support, and/or perceived market acceptability, e.g., if it is known that a casino has a base RTP that is too low, players will perceive the casino as treating players unfairly and will avoid giving it their business. As noted earlier, casinos typically use the BRTP or equivalent when displaying an RTP for a casino gaming machine, as the BRTP gives the player a sense of at least the minimum RTP for that gaming machine but does not provide a level of detail that would allow players to identify, for example, which gaming machine of a cluster of gaming machines having the same BRTP has the highest RTP.

The present inventor conceived of a new type of casino gaming machine or system in which, contrary to industry standard practice and contrary to established norms, the RTP for a gaming machine is not only caused by the gaming controller to be indicated during play, but may also be caused to be updated to reflect the current theoretical RTP (CTRTP) and/or the current session RTP (SRTP). Coupled with such prominent display of RTP-related data, such gaming machines or systems may also, in some implementations, be configured to provide the player with notifications of opportunities for the player to increase the CTRTP of the gaming machine on which they are playing by satisfying certain CTRTP increase conditions. It will be understood that while many of the examples discussed below focus on gaming machines as example implementations, such examples may also be provided as part of a larger gaming system. For example, some gaming machines may, in effect, be "dumb" terminals that merely relay information provided to them from a central determination or central gaming server, which may actually determine what graphics to display, what game outcomes to provide, and so forth. In such implementations, the gaming machine may have little more than a display, user interface controls, speakers, and various other systems that are accessible to the player during play—the rest of the processing and functionality for play of games of chance on the gaming machine may be provided by one or more remote systems. It will be understood that reference herein to a "gaming machine" is inclusive of both stand-alone gaming machines (which do not need to be provided with information from a central server in order to manage or provide game play) and centralized gaming systems, in which some or all of the processing necessary for game play may be offloaded onto one or more remote systems.

The CTRTP is the RTP of a gaming machine according to its present settings and configuration. The CTRTP may, in some instances, be equal to the BRTP, although in most instances it will be higher, as casinos wish to interject some uncertainty into the perceived RTP of gaming machines to cause players to play more in order to try and locate, through experience, gaming machines that are perceived by the players as having higher CTRTPs.

The SRTP is the actual RTP, evaluated based on actual coin-in and actual return to a player, for a gaming session of the player. A gaming session, in this case, refers to all of the wagers placed by the player in a game of chance on a gaming machine over a substantially continuous time period. Gaming sessions are frequently bookended by the insertion and removal of a player loyalty program card or use of another player-identification token, and, for the purposes of this disclosure, generally only include wagering events for the same game of chance (for example, if a gaming machine allowed a player to select between multiple different games of chance, switching games of chance without switching to a new gaming machine would still terminate the current gaming session and initiate a new one). The SRTP may be quite volatile, and will frequently change from wager to wager as the player wins or loses. As the player places more and more wagers, the SRTP will generally become less and less volatile and should, in theory, start to converge towards the CTRTP.

As noted earlier, gaming machines according to the present disclosure differ from typical gaming machines in that some indication of RTP—more specifically, of CTRTP and/or SRTP—is prominently displayed by the gaming machine during or concurrently with play, i.e., without requiring that the player interrupt play to access, for example, another screen or interface of the gaming machine. This runs counter to established industry practice and would generally be considered to be undesirable within the casino gaming industry, as it provides players with more information on which to base their choices of which gaming machines to patronize.

The indications of CTRTP or other RTP-related values may be in the form of a numeric value, e.g., a percentage or other indication of proportion, or a graphical indicator, such as a graph or bar meter that shows in graphical format where the RTP is relative to an easy-to-understand baseline level, e.g., a bar that indicates, by virtue of its length, where the RTP is relative to a minimum RTP value and a maximum RTP value.

In some such implementations, display of such RTP information may, as discussed earlier, be provided in tandem with opportunities for the player to take actions that cause a CTRTP characteristic to increase. A CTRTP characteristic is representative of a CTRTP of a gaming machine, and there may be multiple CTRTP characteristics that are determinable for a gaming machine. For example, CTRTPs may be calculated based on 1000 theoretical plays, 100,000 theoretical plays, 1,000,000 theoretical plays, and so forth—a CTRTP characteristic would be representative of one of these types of CTRTP. CTRTP characteristics for a gaming machine are ultimately determined by settings or configuration elements associated with that gaming machine. It is to be understood that previous reference to displaying an indication of RTP are inclusive of displaying an indication of a CTRTP characteristic.

It should be noted that gaming machines as discussed herein may also be configured to provide for adjustment of the settings of the gaming machine so that the CTRTP is decreased. In some implementations, such gaming machines may be configured to adjust the gaming machine settings to decrease the CTRTP to a lower level or even to reset the CTRTP to the lowest level permitted on the gaming machine. Such CTRTP decreases may be triggered by in response, for example, to a major positive event (from the player's perspective), e.g., the player winning a major award or jackpot, so that the player feels that something of value was obtained in exchange for the loss of the accumulated CTRTP increases. In other implementations, such CTRTP decreases may be triggered by other events, such as reaching a certain point in play. Such triggers may include, for example, the player having played for a specified period of time or having placed a specified number of wagers. For example, the settings of the gaming machine may be adjusted such that the CTRTP of the gaming machine slowly decays over time, e.g., the CTRTP percent decreases by a unit of 0.01% every minute (so that over 10 minutes, the CTRTP may decay from 89.1% to 89.0%). In other implementations, the CTRTP may be decreased in response to user actions, e.g., the user may be presented with an opportunity to play a bonus game in which they are prompted to make a selection between two or more unknown "awards"—one of the "awards" may cause the CTRTP to be increased further, or, in implementations featuring "decaying" CTRTP, may cause the CTRTP decay to be paused for a specified duration of time. However, one or more of the other awards may cause the CTRTP to be decreased by some amount. The outcomes for such bonus games may, in some implementations, be randomly predetermined, i.e., the outcome may be the same regardless of what choice the player makes if they choose to play the bonus game, or may be able to be influenced by player choice, e.g., the outcomes associated with each selectable "award" may be predetermined, but the player's decision actually determines which "award" is provided.

Settings or configuration elements of a gaming machine that may be changed to cause a change in CTRTP may include, for example, the probabilities of particular outcomes, the awards provided for achieving particular winning patterns, the frequency with which "wild" or similar play elements are provided, the number and types of winning outcomes that may be achieved in the game, and so forth. Thus, for example, if a player satisfies the conditions required to cause a CTRTP characteristic to change, the gaming machine may cause one or more settings of the gaming machine to change so as to produce the desired increase in the CTRTP characteristic.

Changes to the CTRTP characteristic caused by such settings changes may then be reflected in the RTP information that is displayed. In most such implementations, the opportunities may be structured so as to provide the player with an opportunity to increase the CTRTP characteristic of the gaming machine by meeting one or more CTRTP increase conditions that are associated with a credit wagering rate of the player on the gaming machine. The credit wagering rate may, for example, be determined based on a) how many wagers the player makes per unit of time, e.g., per minute, and b) the size of those wagers, e.g., the number of credits wagered for each wager. Thus, for example, a player who places three 3-credit wagers, two 2-credit wagers, and four 1-credit wagers in a five minute span would, for that period of time, have a credit wagering rate of 17 credits/5 minutes or 3.4 credits/minute.

Examples of credit wagering rate-related CTRTP increase conditions include, for example, requiring a player to make at least a specified number of wagers (of any denomination) within a given time period, requiring a player to increase or decrease the number of wagers made within a given time period by a specified amount, requiring the player to increase or decrease the amount wagered for a specified number of wagers, and so forth. CTRTP increase conditions that cause a player's credit wagering rate to increase may be particularly beneficial since meeting such conditions will necessarily cause the player to increase the credit throughput rate for the gaming machine. The resulting throughput increase may offset, at least in part and over time, potentially higher winnings on the part of the player due to increases in the CTRTP characteristics. Thus, the casino may take a smaller percentage of the player's credits on average, but the volume of credits wagered may be sufficiently higher that the casino sees increased profits as a result of such a feature.

In some implementations, gaming machines may also include CTRTP increase conditions that actually cause the player's credit wagering rate to decrease, at least temporarily. Such CTRTP increase conditions may be useful, for example, in encouraging players to adopt more responsible wagering habits, or in injecting some variety into the player experience so that the player does not feel like the gaming machine is constantly urging them to increase the rate at which they wager credits.

The opportunities for the player to increase the CTRTP may be provided, for example, by way of notifications to the player. Such notifications may, for example, provide the player with an indication of one or more corresponding opportunities for the player to increase the CTRTP of the gaming machine by satisfying one or more corresponding CTRTP increase conditions. Such notifications may provide an indication of the amount by which the CTRTP characteristic will be increased if the CTRTP increase conditions are met. Such an indication of the amount of CTRTP characteristic increase may be numeric, e.g., "0.1%," or graphical, e.g., "one unit" or "one bar" (if the CTRTP is indicated by a bar graph, for example). In other examples, the notification may simply provide an indication of what the CTRTP will be after the increase, e.g., "increase the CTRTP to 92.1%" (when the CTRTP characteristic is currently at 92.0%).

Figure 3:
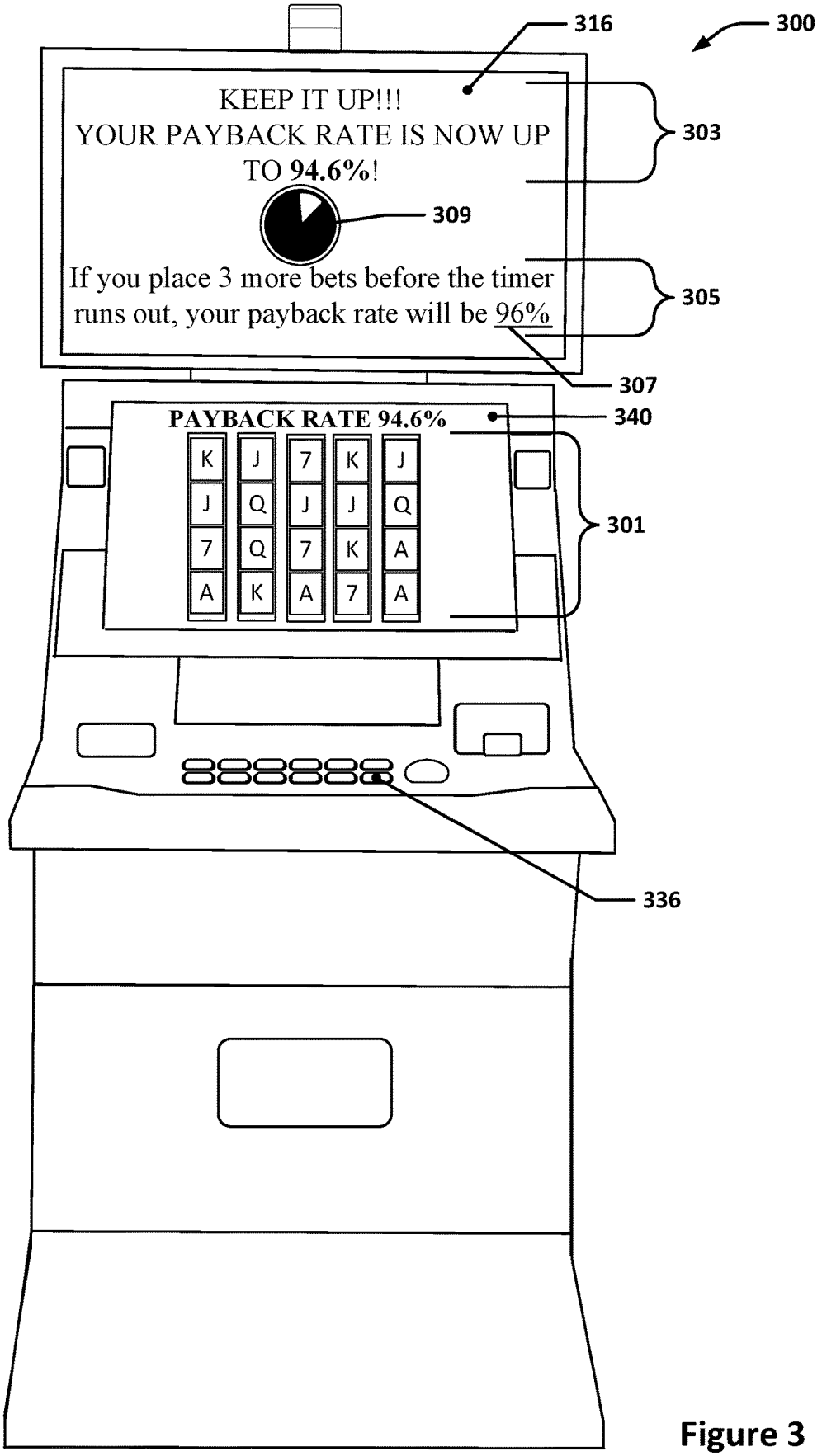
FIG. 3 depicts an example gaming machine offering CTRTP characteristic display and opportunities for the player to increase the CTRTP characteristic by satisfying one or more CTRTP increase conditions.

FIG. 3 depicts an example gaming machine offering CTRTP characteristic display and opportunities for the player to increase the CTRTP characteristic by satisfying one or more CTRTP increase conditions. As can be seen in FIG. 3, a gaming machine 300 is provided that includes a main display 340 that displays a game of chance 301. The main display 340, in addition to the game of chance 301, also displays an indication of a CTRTP characteristic (in this case, a payback rate of 94.6%). The CTRTP characteristic is also displayed on a secondary display 316 by way of indication 303, in this example. The gaming machine 300 may also include buttons 336 that may be used by the player to, for example, place wagers and/or change wager amount.

As can be further seen in FIG. 3, the gaming machine 300 also offers a notification 305 to the player of an opportunity to increase the CTRTP characteristic, in this case by placing three more bets or wagers before a timer 309 expires or runs out. The notification 305 includes information 307 that indicates to the player what the new CTRTP will be after the increase.

Opportunities for the player to increase the CTRTP characteristic of the gaming machine may be time-limited or may be indefinite in duration. For example, one such opportunity may have a CTRTP increase condition that is met when the player wagers a certain number of times before a timer runs out (time-limited). Another opportunity may have a CTRTP increase condition that is met when the player makes a certain number of wagers within a predetermined window of time (the window may be a rolling window, e.g., within the last ten minutes) (indefinite in duration). The gaming machine may monitor the credit wagering rate of the player while the player is playing the subject game of chance in order to determine whether the player's credit wagering rate satisfies whichever CTRTP increase conditions may currently be in effect or pending.

The gaming machine may adjust one or more settings associated with the gaming machine in order to increase the CTRTP characteristic of the gaming machine whenever it is determined by the gaming machine that the CTRTP increase condition(s) for a given opportunity to increase the CTRTP characteristic have been satisfied. The gaming machine may then adjust the indicator of the CTRTP characteristic that is displayed by the gaming machine in order to reflect the increased CTRTP.

As discussed earlier, in some implementations, SRTP may be displayed for a player as well as CTRTP. Generally speaking, the indication of SRTP, if displayed, will be displayed to the player in addition to the indication of the CTRTP characteristic. SRTP, as noted earlier, is generally more volatile than CTRTP (at least, early in a gaming session) and providing indications of both SRTP and CTRTP may be beneficial since a player experiencing lower-than-expected SRTP values (as compared to the CTRTP characteristic) may be reassured that their experience is statistically likely to change for the better, whereas players experiencing higher-than-expected SRTP may feel excitement that they are outperforming the gaming machine. In some such implementations, SRTP may be periodically determined and displayed the player; in some such implementations, the SRTP may be determined and displayed to the player after every game play. In some implementations with SRTP display, the SRTP may only start to be displayed for a gaming session after a predetermined number of wagers has been made or after the SRTP exceeds a given value or stays above a given value for a predetermined consecutive number of game plays—this may avoid displaying an SRTP that is highly volatile and/or discouraging. For example, if the first 1-credit wager that a player makes on a gaming machine results in a 1 credit win, the SRTP would be 100% or 1.0, but if the next 1-credit wager results in no winnings at all, the SRTP will drop 50% to 0.5 or 50%, which may be alarming and/or discouraging. By waiting until a sufficient number of wagering events have occurred to build up a buffer against such volatility before displaying the SRTP, a gaming machine may avoid unduly alarming or distressing a player.

In some instances, multiple opportunities for increasing the CTRTP characteristic of the gaming machine may be provided to a player concurrently. For example, there may be different tiers of CTRTP increase conditions that may require different levels of player achievement. For example, one CTRTP increase opportunity may allow the player to increase the CTRTP characteristic by amount X if the player increases the number of wagers placed to 10 wagers per minute, while another concurrently offered CTRTP increase opportunity may allow the player to increase the CTRTP characteristic by amount Y if the player maintains their wagering rate at the current level.

In some implementations, gaming machines that provide players with opportunities to increase a CTRTP characteristic of the gaming machine may be configured to generally only increase the CTRTP characteristic for a player for the duration of a gaming session. In such implementations, the CTRTP characteristic, once raised or incremented, may remain at that level for the duration of the session. However, if a player fails to meet certain milestones or requirements during play, the progress that they may have made towards satisfying a CTRTP increase condition may be reset. This may spur the player to remain more engaged with the game play.

In some implementations of gaming machines that provide CTRTP characteristic display and opportunities for players to increase the CTRTP, the gaming machines may be additionally configured to provide semi-automatic wagering features that may allow a player to more easily satisfy CTRTP increase conditions or that may make doing so more engaging and enjoyable for the player. For example, in some implementations, a gaming machine may be equipped with a rate selector and an automatic wagering sensor of some sort. The automatic wagering sensor may provide first data that serves to indicate to the gaming machine that automatic wagering should occur, and may take a variety of forms. In many respects, the automatic wagering sensor may act as a "deadman" switch that activates when a player is present and is actively operating the gaming machine, but which deactivates when the player, for example, gets up, takes their hand off a button, takes a foot off a pedal, or takes some other action to indicate that automatic wagering should stop. The automatic wagering sensor may, for example, be analogous to a lanyard cutoff switch on a jet ski (which turns off the jet ski if the rider falls off). The automatic wagering sensor may take any of a variety of forms. For example, an automatic wagering sensor, at its simplest, may take the form of a standard button or on-screen touch control that the player must actively hold down in order to engage automatic wagering feature. In other examples, an automatic wagering sensor may be more subtly integrated into a gaming machine. For example, a wagering machine may have an occupancy sensor that is integrated into the seat of the gaming machine to detect when a person is sitting in the seat; if the presence of a person is detected (and the gaming machine is otherwise ready to initiate wagering, e.g., the person has provided credits for wagering, selected a game, etc.), the gaming machine may enter an automatic wagering mode for as long as the person remains seated. In some implementations, gaming machines may be configured with imaging sensors or other systems that may be configured for gaze detection, i.e., to detect when a player's eyes are directed towards a particular area or region of the gaming machine display. In such implementations, the imaging sensors or other systems may serve as the automatic wagering sensors, with automatic wagering being initiated when such sensors determine that the player is, for example, looking at a particular region of the display associated with game play. In such gaze-detection based systems, the gaming machine may, in some instances, only initiate automatic wagering when the player's gaze is directed at a very specific area of the display, e.g., a region that has a message like "Look here to start wagering!" One automatic wagering has begun, the gaming machine may expand the gaze region to include the entire display of the gaming machine, or some other area larger than the initial region; as long as the player maintains their gaze within this larger area, the gaming machine may continue to place wagers automatically. However, if the player looks away from the larger area, or looks away from the larger area for at least a predetermined period of time, the gaming machine may interpret the data from the gaze sensor as indicating that automatic wagering should be disengaged or paused. Generally speaking, the gaming machine may cause automatic wagering to occur responsive to data from the automatic wagering sensor meeting a particular automatic wagering condition or conditions, for example, consistent with what is described above or elsewhere in this disclosure, or other conditions that will be evident to those in the industry of casino gaming.

In some implementations of such gaming machines, the automatic wagering sensor may include multiple sensor types or technologies. For example, an automatic wagering sensor may be provided through a combined mechanism that includes both a standard button and a seat occupancy sensor. The standard button may be used to initiate automatic wagering, and the data from the seat occupancy sensor may be used to determine if automatic wagering should be maintained once it has begun.

A gaming machine with automatic wagering capability may, when such a mode is engaged, operate generally autonomously until some condition, such as the automatic wagering mode being disengaged, the available credits being depleted below a preset threshold, or a winning event of a predetermined magnitude occurring, causes it to stop. During such generally autonomous operation, the gaming machine may place wagers (and engage game play) using the player's credits at a particular rate and wager amount. In a typical slot machine, a player must actively push a button or buttons for each game play in order to place a wager and obtain a game outcome. In a gaming machine with automatic wagering, however, the gaming machine may, in effect, stand in for the player and generate signals that cause game plays to occur, and wagers to be placed, without the player having to take a corresponding discrete action for each game play/wager.

While automatic wagering, when engaged, may require no player input in order for wagers to be placed and game plays to occur, the player may still be able to affect the nature of the automatic wagering through the rate selector, which may be a mechanism that allows the player to adjust the credit wagering rate that governs how fast the automatic wagering feature of the gaming machine actually wagers credits. The rate selector may include a device or devices that permit the player to adjust one or both of the amount wagered (wager amount) for each automatic wager and the rate at which wagers are placed (wagering frequency). In some implementations, the rate selector may only allow the player to adjust one of these two settings. The gaming machine may, responsive to inputs received from the player via the rate selector, modify the credit wagering rate of the automatic wagering feature, e.g., by increasing or decreasing the amount wagered for each wager and/or by increasing or decreasing the rate at which wagers are automatically placed.

The rate selector, as with the automatic wagering sensor, may take a variety of forms. In some implementations, the rate selector may take the form of physical buttons or on-screen touch controls which may be straightforward for a player to use. In more complex implementations, the rate selector may be more purpose-specific, e.g., a throttle control, such as may be found on a motorcycle, an accelerator pedal such as may be found on a car, a flight control stick that may be found on an airplane, and so forth.

Gaming machines with automatic wagering sensors and rate selectors may be configured, in some instances, to provide the player with continuous or near-continuous ability to adjust the automatic wagering rate using the rate selector, e.g., the player may, generally adjust the wagering rate at any time. In such gaming machines, there may be a secondary game or entertainment experience that is tied to the operation of the rate selector. For example, a gaming machine may provide graphical content (in addition to the game of chance) that is, in some way, dependent on the operation of the rate selector. Such content may, in some instances, play a role in the opportunities provided to the player to increase the CTRTP of the gaming machine.

For example, in some gaming machines, the gaming machine may be configured to provide graphical content that depicts some sort of progression through a graphical environment—either progression of the viewer through the graphical environment (e.g., a first-person point-of-view) or of an object through the graphical environment (e.g., a third-person point-of-view), with the nature of the progression being affected by the rate selector. Examples of such types of gaming machines are discussed below.

Figure 4:
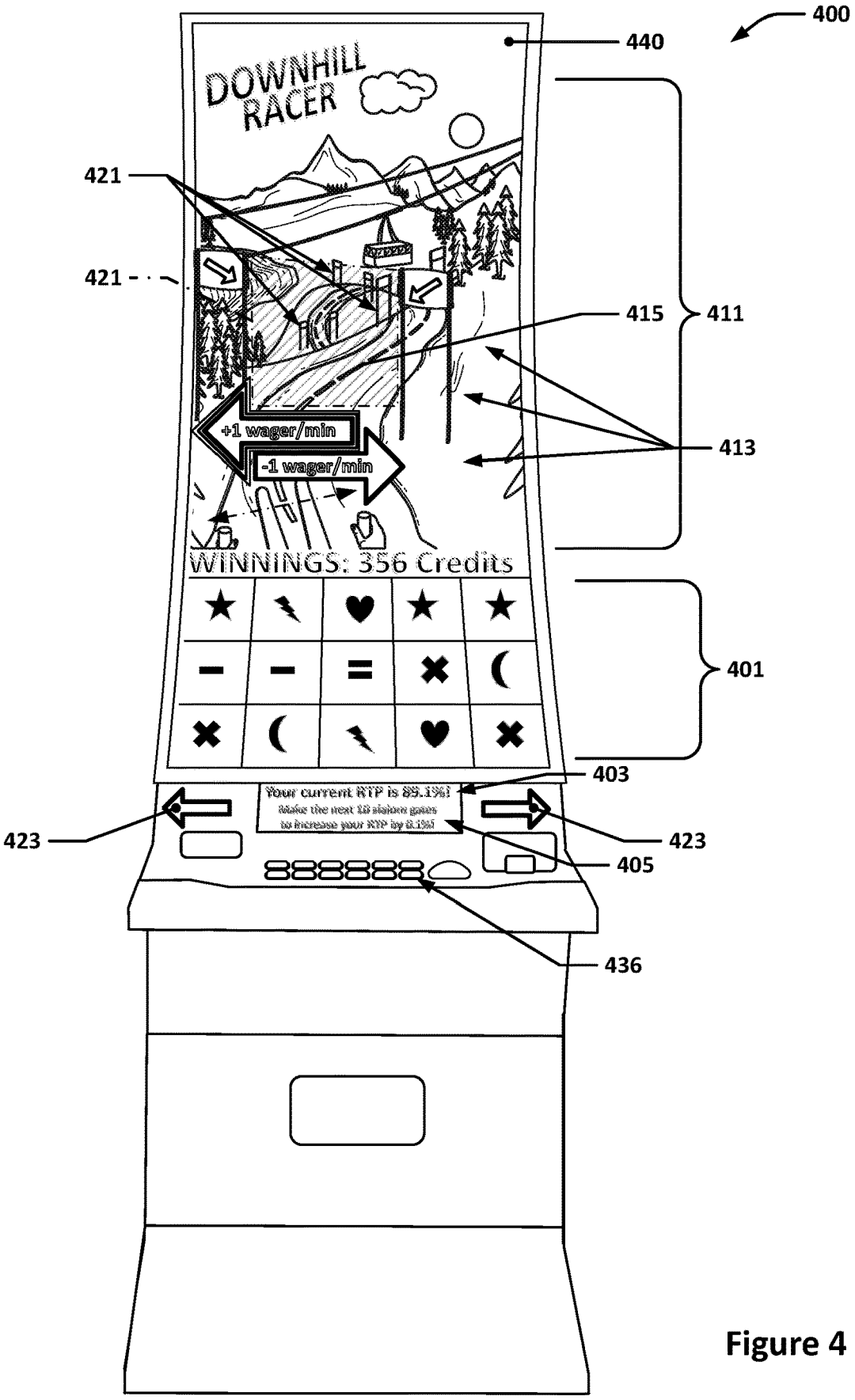
FIG. 4 depicts another example gaming machine offering CTRTP characteristic display and opportunities for the player to increase the CTRTP characteristic by satisfying one or more CTRTP increase conditions.

FIG. 4 depicts an example gaming machine offering CTRTP characteristic display and opportunities for the player to increase the CTRTP characteristic by satisfying one or more CTRTP increase conditions. In FIG. 4, a slot machine gaming machine 400 is shown and offers a game of chance 401 on a main display 440 of the gaming machine 400 for play. The gaming machine 400 is configured to provide an indication 403 of CTRTP for the gaming machine 400, and also provides a notification 405 of an opportunity for the player to increase the CTRTP. The opportunity, in this case, is tied to the display of graphical content 411 in the region of the main display 440 above the game of chance 401. Buttons 436 may allow the player to control various aspects of the gaming machine.

In this case, the graphical content 411 includes the display of a graphical environment 413 that, in this example, is a first-person point-of-view display of a downhill skiing slalom course. The first-person point-of-view serves to make the player feel as if they are skiing. While automatic wagering is occurring, the graphical content may be animated so that the viewpoint may largely follow a predetermined path 415 (shown graphically here, but not necessarily depicted at all in actual practice) through the graphical environment, causing the player to experience a view similar to what a downhill skier might experience when skiing down a mountain. The player may, for example, be able to somewhat influence the viewpoint's progression through the environment, e.g., by causing the viewpoint to traverse left or right relative to the predetermined path 415. Such movement may, for example, be tied to the inputs provided by the player via rate selector 423 which, in this case, is provided by a pair of left/right arrow buttons. In this example, pushing the left arrow button may cause the viewpoint to move to the left relative to the predetermined path, and pushing the right arrow button may cause the viewpoint to move to the right relative to the predetermined path. As the viewpoint progresses along the predetermined path, various targets 421 lying along the predetermined path 415 may be encountered. The targets 421, in this example, are slalom gates or, more specifically, the zone between each pair of gates. Such targets 421 may be transversely offset from the predetermined path 415 by various distances such that the player must move the viewpoint left or right relative to the predetermined path using the rate selector 423 to cause the viewpoint to align with and pass through each target 421. Passing through a target 421 successfully may cause the speed with which the viewpoint moves through the graphical environment 413 to increase or remain the same, for example, whereas missing a target 421 may cause the speed with which the viewpoint moves through the graphical environment 413 to decrease or otherwise indicate disruption of the player's movement through the graphical environment 413.

The gaming machine may be configured to cause the wagering rate and/or the wager amount to increase or decrease based on the inputs provided by the player via the rate selector. The display 440, in this particular example, depicts arrows indicating that pushing the left arrow button of the rate selector 423 will cause the gaming machine to increase the wagering rate by an additional wager per minute, whereas pushing the right arrow button of the rate selector 423 will cause the gaming machine to decrease the wagering rate by one wager per minute. The gaming machine may, prior to each target, change the effect caused by pushing the left or the right arrow button (or, in some instances, the gaming machine may not implement any changes to the wagering rate and/or wager amount for one or both potential arrow button pushes for some targets). Thus, for example, while pushing the left arrow button 423 would cause the wagering rate to increase by one credit per minute in the state that the gaming machine 400 is in in FIG. 4, the gaming machine may cause the wagering rate and/or wager amount to decrease by some amount, increase by a different amount, or change not at all for the next press of the left arrow button, and so forth. While note shown in this Figure, the gaming machine 400 may also have an automatic wagering sensor that produces data that causes the gaming machine 400 to actually engage in automatic wagering based on the wagering rate and/or wagering amount determined by the data from the rate selector 423. For example, the player may need to hold down one of buttons 536 to engage automatic wagering, or possibly depress a foot pedal (not shown) to engage automatic wagering.

The gaming machine may be configured to provide opportunities 405 to the player to change the CTRTP, as discussed above. In this case, the opportunity has a CTRTP increase condition that is linked to the player's successful navigation through the next ten targets 421. Other opportunities may have other types of CTRTP increase conditions.

Figure 5:
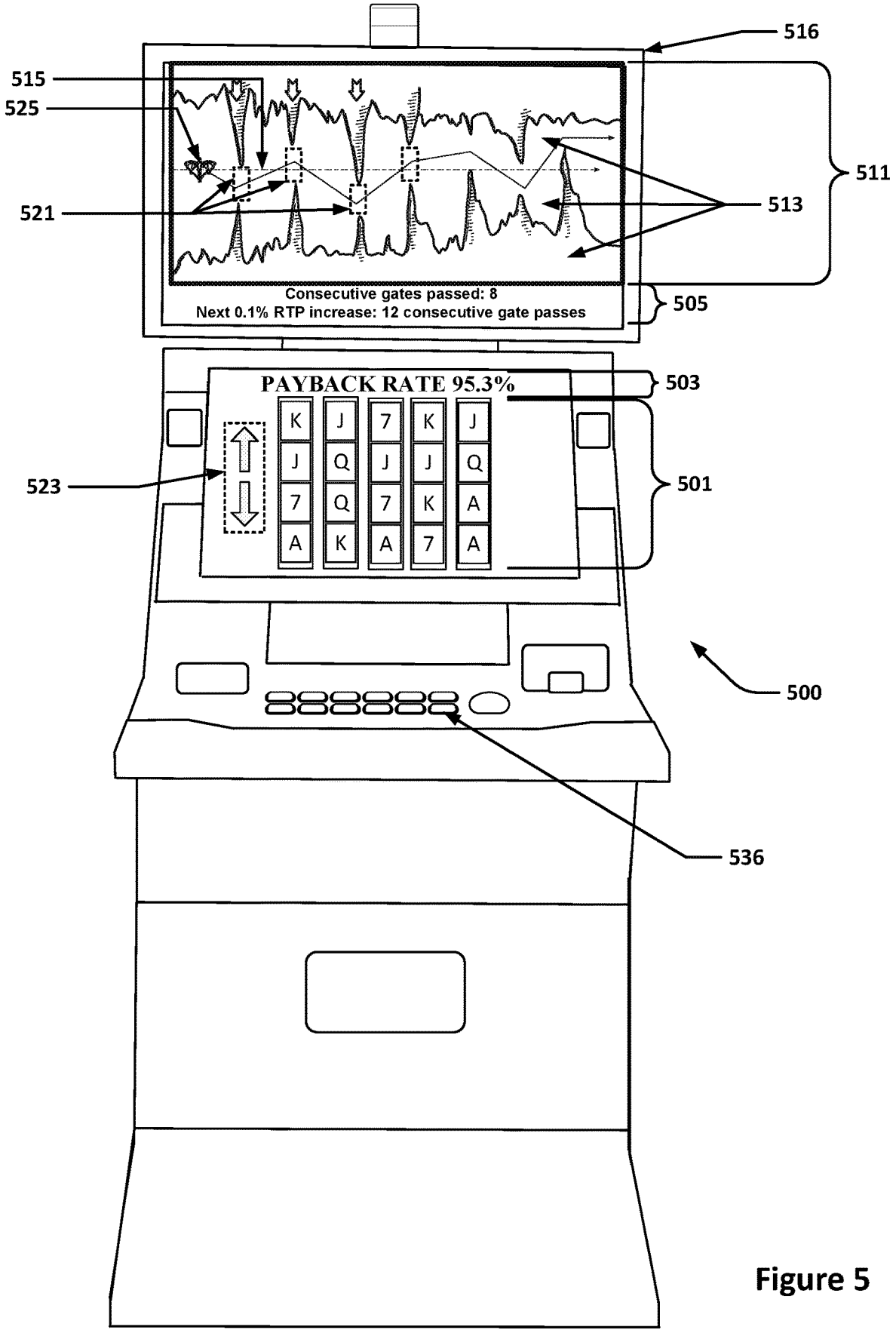
FIG. 5 depicts another example gaming machine offering CTRTP characteristic display and opportunities for the player to increase the CTRTP characteristic by satisfying one or more CTRTP increase conditions.

FIG. 5 depicts another example gaming machine that is configured to display CTRTP and to allow a player to increase the CTRTP through satisfying CTRTP increase conditions. In FIG. 5, a gaming machine 500 is depicted that provides a game of chance 501. The gaming machine 500 may be configured to depict an indication of a CTRTP characteristic 503 for the gaming machine 500. The gaming machine 500 may also be configured to provide notifications 505 of opportunities to increase the CTRTP to the player. As with the gaming machine 400, the gaming machine 500 features a rate selector 523 with two arrow buttons (which are touch screen controls, in this case), although this time, the arrow buttons are oriented vertically instead of horizontally. The rate selector 523 buttons, in this example, may cause the wagering rate to increase (if the up button is selected) or decrease (if the down button is selected); each button selection/push may cause the wagering rate to increase or decrease by one unit. The gaming machine 500 may also have an automatic wagering sensor, e.g., a button 536 that is pressed by the player, to engage automatic wagering mode.

The gaming machine 500 may have a secondary display 516 that may display graphical content 511 that depicts a graphical environment 513. Unlike the graphical environment 413, the graphical environment 513 is presented from a third-person point of view and has the appearance of a side-scrolling cave, with stalagmites and stalactites that, between them, form targets 521 (indicated by dotted rectangles here, although such dotted rectangles may not actually be visible during actual presentation of the graphical environment 513), which are gaps that are large enough to allow a graphical object 525 to pass through. The graphical environment 513 may, in this case, be caused to scroll or move relative to the secondary display 516 along path 515 during automatic wagering, thereby causing the targets 521 to sequentially approach the graphical object 525. The graphical object 525, which is a flying bat in this example, may be caused to move vertically up or down relative to the secondary display 516 responsive to the player pressing either the up or the down button, respectively, of the rate selector 523. As the graphical environment 513 moves across the secondary display 516, the player may need to continually adjust the vertical location of the graphical object 525 (and thus the wagering rate) so that the graphical object aligns with and passes through each target 521 as it passes by the corresponding target 521.

As discussed, the gaming machine may provide notifications 505 of opportunities for the player to increase the CTRTP of the gaming machine 500; in this case, the gaming machine has informed the player that the CTRTP will be increased by 0.1% if the player causes the graphical object 525 to successfully pass through 12 consecutive "gates" (targets 521); the player has, in this example, already successfully navigated the graphical object 525 through eight previously displayed gates/targets 521 that have since passed out of view on the secondary display 516, and must only successfully navigate through the next four gates/targets 521 that are displayed in order to satisfy the CTRTP increase conditions associated with the opportunity that the notification 505 regards. As the player provides feedback through the rate selector 523, the graphical object 525 may appear to follow a path that travels up and down through the graphical environment, e.g., following a path such as that illustrated by the solid-line arrow, as it successfully navigates through the targets 521. If the player fails to satisfy all of the CTRTP conditions of the opportunity, the opportunity may, in some instances, be replaced by a new opportunity or the player's progress towards completing the opportunity may be reset. For example, if the player in the depicted example were to miss the next gate/target 521, their progress towards meeting the goal of successfully navigating through 12 gates/targets 521 might be reset to zero gates/targets. Upon satisfying the CTRTP increase conditions associated with the opportunity, however, the CTRTP characteristic of the gaming machine 500 may be increased by the indicated amount of 0.1%, and a new opportunity for increasing the CTRTP characteristic of the gaming machine 500 may be presented (although such presentation may not immediately follow the most recent CTRTP increase).

Figure 6:
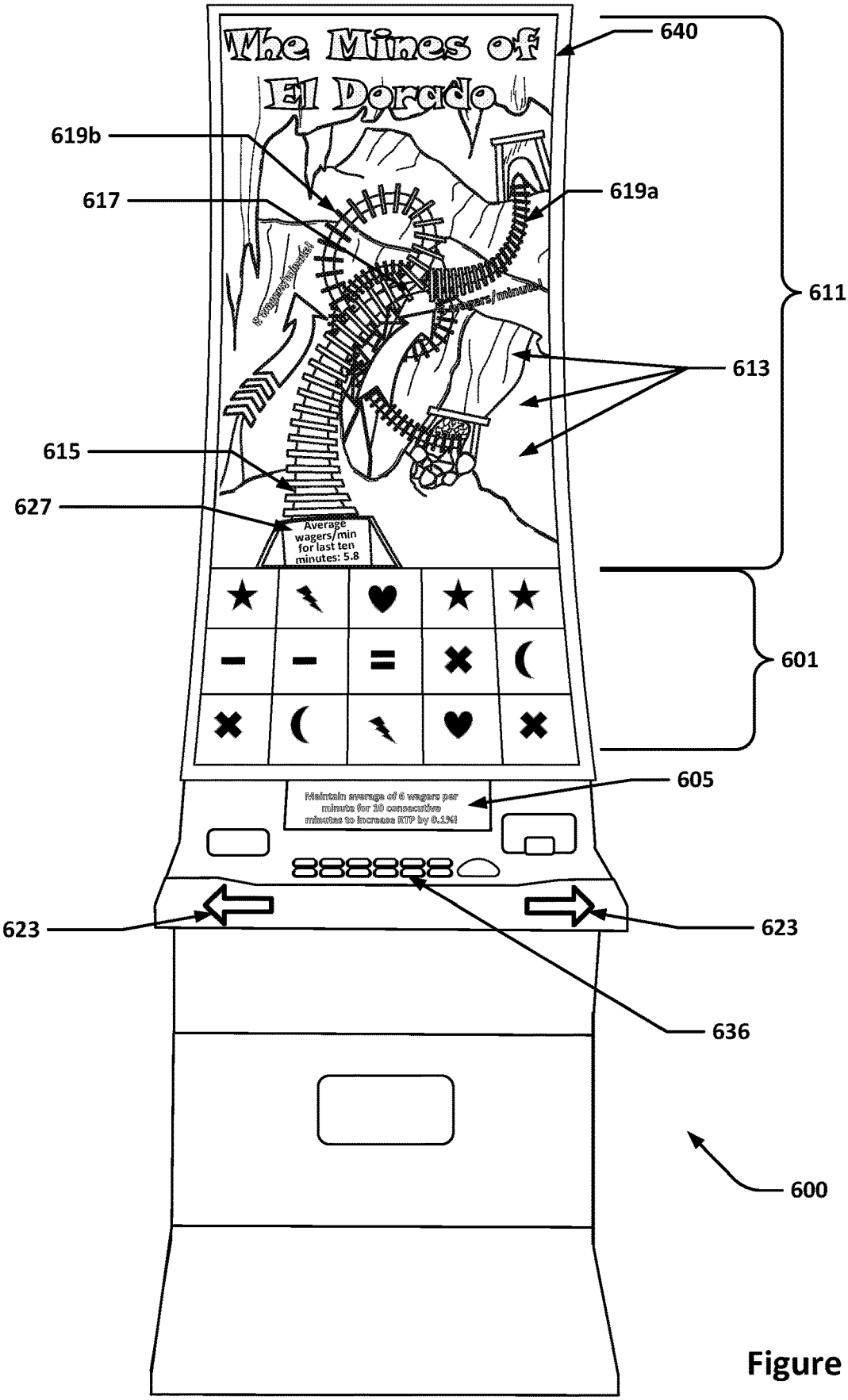
FIG. 6 depicts another example gaming machine offering CTRTP characteristic display and opportunities for the player to increase the CTRTP characteristic by satisfying one or more CTRTP increase conditions.

FIG. 6 depicts another example gaming machine that is configured to display CTRTP and to allow a player to increase the CTRTP through satisfying CTRTP increase conditions. In FIG. 6, a gaming machine 600 is provided that has a main display 640 that may display a game of chance 601 and graphical content 611 that depicts a graphical environment 613. In this example, the graphical environment is a first-person point-of-view depiction of what it would look like if the first-person point-of-view were filmed from a mine cart that was travelling along a set of mine cart tracks through a mine or cave system. The mine cart tracks may be thought of as establishing a predefined path 615 that occasionally has branch points 619, e.g., track switches in this example, that allow the player to choose between a plurality of potential branches 619.

As with the gaming machine 400, the gaming machine 600 has a rate selector 623 that includes a pair of left and right arrow buttons that allow the player to choose between the two displayed branches (if the gaming machine is configured to display branch points with more than two options, the rate selector may be configured to allow for additional levels of selection by the player). In some implementations, the gaming machine may be configured to allow the player to select a particular branch by simply activating a touch-sensitive area of the main display 640 that corresponds with the desired branch. In other implementations, the rate selectors may be included as part of the buttons 636 that allow a player to control various other game functions.

Each branch 619 that is offered at a branch point 617 may be associated with a different change in wagering rate and/or wager amount; the player's selection of a particular branch 619 may thus act as a player-provided input that causes the gaming machine to modify its automatic wagering behavior to reflect the changed wagering rate and/or wager amount. In this case, choosing branch 619*a* causes the gaming machine to automatically wager at a rate of 5 wagers per minute, whereas choosing branch 619*b* causes the gaming machine to automatically wager at a rate of 8 wagers per minute. The graphical experience that is provided after a branch point may vary depending on the branch taken—for example, if the player opts for the 5 wagers per minute branch 619*a* in FIG. 6, the viewpoint may follow the track that curves off to the right, which is relatively uneventful. However, if the player opts for the 8 wagers per minute branch 619*b* in FIG. 6, the viewpoint may follow the track that curves off to the left, which corkscrews twice as it dives underneath the pre-branch point track and then enters a cave much further down; thus, the left branch 619*b* may lead to a more exciting and faster-speed traversal through the graphical environment 613 than the right branch 619*a* (and may also lead to a higher wagering rate and more energetic game play of the game of chance 601).

The gaming machine 600 may provide information 627 regarding how a player is situated with respect to performance metrics that may be part of the CTRTP increase condition. For example, in the example presented in FIG. 6, the gaming machine 600 has provided a notification 605 that indicates that the player will receive a CTRTP increase if they maintain an average of 6 wagers per minute (which may also, in some implementations, be understood to be inclusive of wagering rates greater than or equal to 6 wagers per minute); the information 627 may indicate that they currently have an average wagering rate of 5.8 wagers per minute over the last ten minutes. The player may then opt for increasing their wagering rate by choosing the left branch 619*b* so as to satisfy the CTRTP increase condition detailed in the notification 605.

In some implementations such as that shown in FIG. 6, the gaming machine may also have an automatic wagering sensor, similar to that discussed earlier for other gaming machines. In such implementations, automatic wagering may only occur responsive to player input to such an automatic wagering sensor. Other such gaming machines, however, may simply automatically wager upon selection of a particular branch and may continue to do so until the next branch point is reached. Thus, for example, selection of a particular branch may simultaneously act to provide data for a rate selector and data for an automatic wagering sensor. In such implementations, the periods between branch points may be sufficiently short or predictable that the player does not feel that they will be locked in to a selected wagering rate and/or wager amount for an undesired length of time. For example, the gaming machine may provide branches that may establish wagering rates that are expressed in terms of wagers per minute, and each branch point may be a minute or some whole multiple of a minute after the previous branch point, so the player may be easily able to predict how many wagers will be placed at that wagering rate and have a good sense of what commitment in terms of overall number of wagers placed their selection will result in.

In some implementations that implement automatic wagering functionality, the gaming machine may also include an "emergency brake" function that the player may activate in order to halt, pause, or otherwise slow down game play. The gaming machine, upon receiving input that indicates that the player has activated the emergency brake feature, may cause, for example, automatic wagering to stop entirely. In other implementations, the gaming machine may cause less drastic action to occur responsive to receiving the emergency brake signal, such as, for example, lowering the wagering rate to a lower setting (or the lowest setting possible), but still allowing automatic wagering to continue at that reduced setting. In gaming machines with automatic wagering sensors, an emergency brake feature may be somewhat redundant, since the player may cause automatic wagering to stop by causing the input to the automatic wagering sensor to stop being applied.

Figure 7:
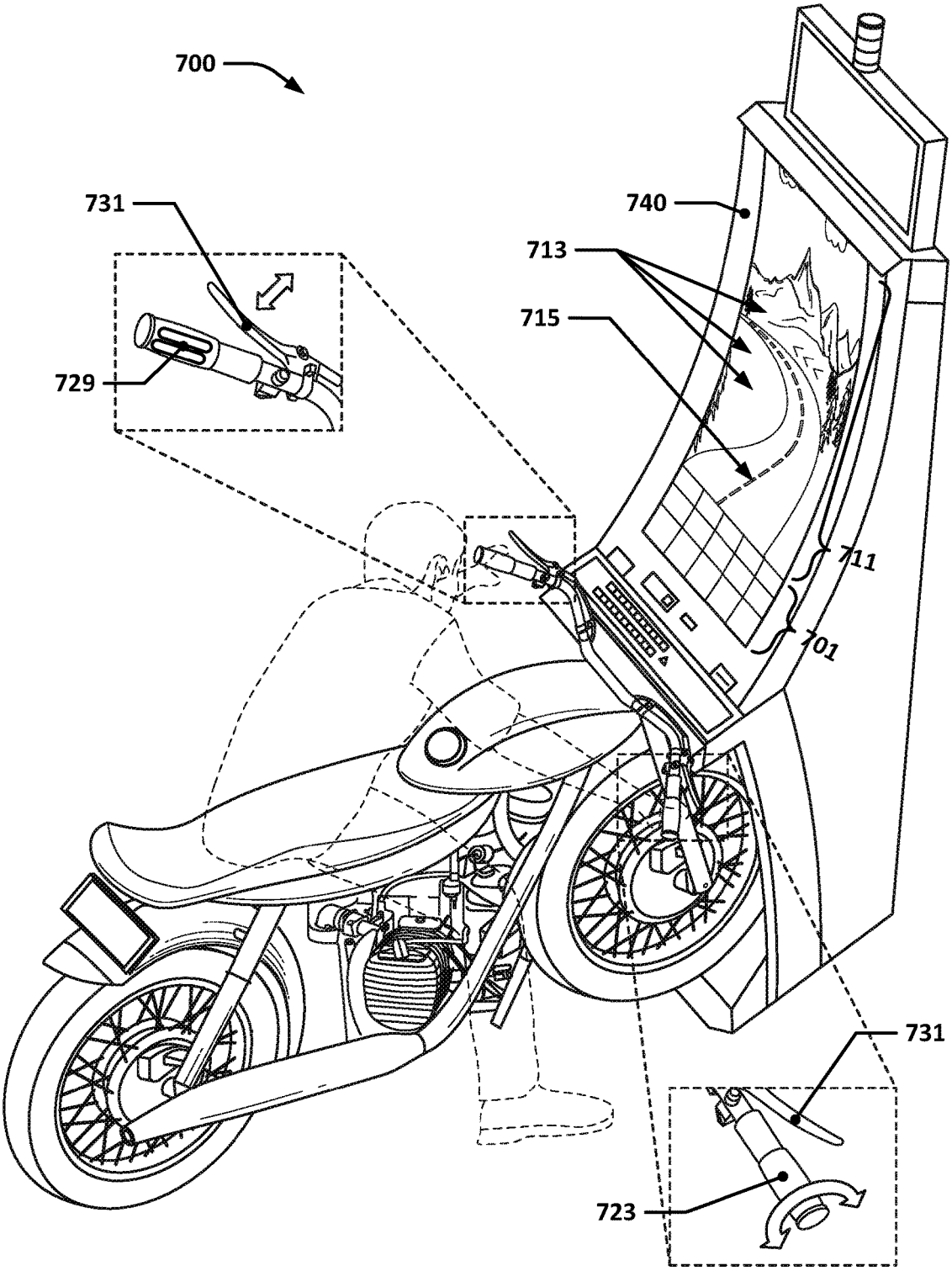
FIG. 7 depicts another example gaming machine offering CTRTP characteristic display and opportunities for the player to increase the CTRTP characteristic by satisfying one or more CTRTP increase conditions.

FIG. 7 depicts another example gaming machine that is configured to display CTRTP and to allow a player to increase the CTRTP through satisfying CTRTP increase conditions. In FIG. 7, a gaming machine 700 is depicted that has a motorcycling theme. In this instance, the gaming machine 700 also includes a portion that is constructed to actually look like a motorcycle; the player (an outline of which is shown here in broken lines), when playing the gaming machine 700, may sit astride the motorcycle portion, just as if they were riding a real motorcycle. The gaming machine 700, in this example, is designed such that the player may control automatic wagering settings for the gaming machine 700 while "riding" the motorcycle, i.e., with their hands on the handlebars. In this instance, the right handlebar has a twist-throttle mechanism (the handgrip may be twisted to "accelerate" or "decelerate" the wagering rate) rate selector 723, and the left handlebar has a skin-contact sensor (two electrodes that detect conductance changes caused by both of them contacting human skin) that serves as an automatic wagering sensor 729; when a person's hand is on the left handlebar and causes the skin-contact sensor to register the presence of the person's hand, this may cause the automatic wagering sensor to indicate that automatic wagering is to occur. In this instance, the handlebars also include emergency brakes 731, which may be used by the player as described earlier. In some implementations of a motorcycle-themed gaming machine, such as that shown, the rate selector may also include a "gearshift" control, e.g., another handlebar-mounted control or a foot-activated control, that may provide data that controls the denomination or wager amount used for automatic wagering, e.g., first gear may be equivalent to 1-credit wagers, second gear equivalent to 2-credit wagers, third gear equivalent to 3-credit wagers, and so forth.

The gaming machine 700 may be configured, as with previous gaming machines discussed herein, such that it displays a CTRTP characteristic to the player; in this specific depiction, the CTRTP characteristic (and notification(s) of opportunities for the player to increase the CTRTP characteristic) is not visible in the Figure, but it will be understood that such display may be provided in a manner similar to other implementations discussed earlier.

In implementations such as the gaming machine 700, the experience of the player may be extremely immersive, with the player actually sitting on or in a replica of a vehicle and with graphical content 711 displayed over a game of chance 701 on a main display 740 of the gaming machine 700; the graphical content 711 may depict a graphical environment 713 that replicates what the player might see if actually, in this instance, driving down a road on a motorcycle. In this particular instance, the manipulation of the rate selector 723 by the player may be used to cause the automatic wagering behavior of the gaming machine 700 to be modified in accordance with the inputs received via the rate selector 723, although the presentation of the graphical environment 713 may largely remain unaffected by such changes and may, for example, simply follow a predetermined path 715 through the environment (in this case, a road). For example, the graphical environment 713 may exist simply for the sake of passively entertaining the player and the player may not be required to, for example, adjust the wagering rate to navigate through targets, as discussed earlier with respect to other implementations. In some implementations, the speed with which the viewpoint travels through the graphical environment may vary depending on the wagering rate selected by the player, although this may be generally a cosmetic change, e.g., the player may ignore the graphical content 711 entirely, if desired, without suffering a potential penalty (whereas in gaming machines in which the player must provide some navigational input in order to, for example, align an object or viewpoint with targets, ignoring the graphical content would likely cause them to fail to satisfy the CTRTP increase conditions and thus fail to increase their CTRTP) .

In some implementations of casino gaming machines having CTRTP characteristics that are displayed to the player and that may be increased responsive to player actions, the gaming machines may be further configured to provide some form of sensory feedback or multimedia display responsive to a CTRTP increase event. For example, in the motorcycle-themed gaming machine of FIG. 7, the gaming machine may engage vibramotors within the "motorcycle" portion of the gaming machine that the player sits on in order to simulate the vibrations that might be experienced on a real motorcycle when accelerating and/or cause loudspeakers connected with the gaming machine to generate particular motorcycle sounds, such as the distinctive rumble of an accelerating muscle bike. Gaming machines, depending on their themes, may have a variety of different user experience devices or "celebration" mechanisms for providing celebratory feedback to the player when CTRTP is increased. Such mechanisms may include, for example, vibratory and/or auditory elements as mentioned previously, but may also include other types of mechanisms or devices, including, for example, smoke or fog machines, laser emitters (which may generate light patterns in such smoke or fog), strobe lights, topper display animations, linear or rotary actuators or motors that cause portions of the gaming machine to move or change physical orientation, and so forth.

Figure 8:
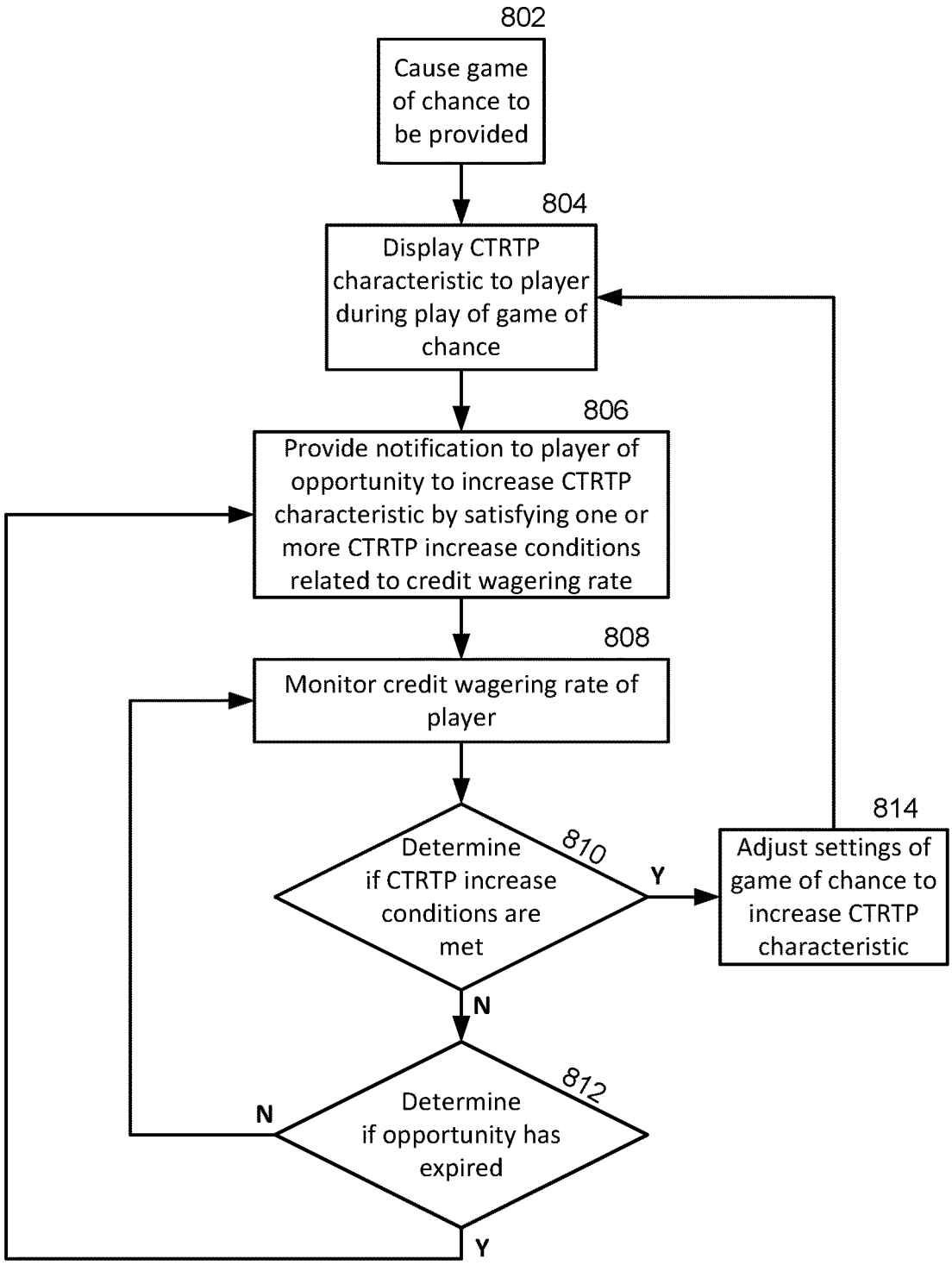
FIG. 8 depicts a block diagram of a general technique for operating a gaming machine according to the concepts discussed herein.

A block diagram of a general technique for operating a gaming machine according to the concepts discussed herein is depicted in FIG. 8. Such a technique may begin in block 802, in which a gaming system may be caused to provide a game of chance for a player. In block 804, the gaming system may be caused to display a CTRTP characteristic for the game of chance during play of the game of chance, as discussed previously herein. In block 806, the gaming system may be caused to provide a notification to the player of an opportunity to increase the CTRTP of the gaming machine by satisfying one or more CTRTP increase conditions related to the credit wagering rate of the player.

In block 808, aspects of the credit wagering rate of the player may be monitored (such as the wagering frequency and/or the wager amount), and in block 810, it may be determined whether the one or more CTRTP increase conditions associated with the opportunity have been met by the player. If so, then the technique may proceed to block 814 where the gaming machine or system may be caused to adjust its settings responsive to the CTRTP increase conditions being met so that the CTRTP is increased in accordance with the opportunity to increase the CTRTP.

If it is determined in block 810 that the one or more CTRTP increase conditions associated with the opportunity have not been met by the player, the technique may, in some implementations, proceed to block 812, where a determination may be made as to whether the current opportunity for the player has expired. If so, then technique may return to block 806 and the current notification of an opportunity may be replaced by a new notification. Alternatively, in some implementations, the player may be notified that the current opportunity has expired, and some period of time may be allowed to elapse before a notification of a follow-on opportunity is provided to the player. If the opportunity has not expired, or if the opportunity does not have an expiration, the technique may return to block 808 for further monitoring. Such a technique may be repeated as desired for additional opportunities, until a maximum CTRTP characteristic is reached, until the player stops playing the game of chance, or under some other condition is met. It is to be noted that in some implementations, a gaming machine may actually permit a player to raise the CTRTP characteristic to more than 100%, at least for some limited predetermined period of time.

A player who invests significant time in playing a particular gaming machine during a gaming session may be provided with multiple opportunities to increase the CTRTP characteristic of that gaming machine. With sufficient investment of time and through pursuing the various opportunities provided, the player may significantly increase the CTRTP of the gaming machine. In some implementations, such a gaming machine may be configured with functionality, or be connected with a server that provides functionality, that permits the player to "pass on" the enhanced CTRTP (or some portion thereof) to a subsequent player in exchange for some sort of compensation.

For example, when a player is done or close to done with a gaming session on a gaming machine and wishes to seek out a potential "inheritor" of the gaming machine, they may provide an input to the gaming machine that causes the gaming machine to enter a mode in which it seeks out another player that wishes to "take over" the gaming machine. While in this mode, the gaming machine may communicate with a request server that may assign another player to the gaming machine.

The request server, for example, may be configured to receive request signals from a plurality of other players, all of whom, by providing the request signal, have indicated a desire to take over play on a CTRTP-enhanced gaming machine. The request server, upon receiving a player input signal, e.g., a signal from the gaming machine indicating that the player wishes to stop playing the gaming machine, may evaluate data associated with each request signal that it has received for players that are still pending, i.e., that have not otherwise been disposed of, e.g., by being withdrawn or where the player associated with the request signal having already been assigned to another gaming machine, to see if any of the players associated with the request signals satisfies one or more transfer conditions. Such transfer conditions may govern how a gaming machine is transferred to another player. If a particular player satisfies the one or more transfer conditions, the request server may cause the gaming machine to be allocated to that particular player and may notify that player of the location of the gaming machine and the time by which they must show up and log in to the gaming machine in order to obtain the benefit of the enhanced CTRTP. The request server may also cause the gaming machine to preserve the enhanced CTRTP after the player who is playing the gaming machine stops doing so, thus allowing the follow-on player to obtain the benefit of the enhanced CTRTP.

In some implementations, the one or more transfer conditions may, for example, include conditions that are satisfied based on how long each player associated with a request signal has been waiting to be allocated a gaming machine. For example, the request server may allocate gaming machines to players that have been waiting the longest before allocating gaming machines to players who have been waiting for shorter periods of time. The time that each player associated with a request signal has been waiting may be based on the timestamps of the request signals.

In other implementations, the one or more transfer conditions may, for example, include conditions or additional conditions that are satisfied when the follow-on player agrees to compensate the current player of the gaming machine in some manner. For example, the follow-on player may agree to pay the current player of the gaming machine an amount of credits in return for being allowed to make use of the current player's enhanced CTRTP. Another example is when the follow-on player may agree to pay the current player some portion or percentage of their winnings from the gaming machine using the enhanced CTRTP during a specified period of time after the follow-on player takes over play of the gaming machine. In other instances, potential follow-on players may provide bidding information regarding an amount of a bid that each is willing to pay for the privilege of taking over play on the gaming machine. The request server may, in such cases, evaluate the bidding information for each player waiting for a gaming machine when a gaming machine becomes available for play (or will soon be available for play) and select a winning player based on the highest bid provided. The request server may then allocate the gaming machine to the winning player.

The request server may, in some instances, provide the ability for players who are waiting for a gaming machine to specify one or more filter conditions that may be used by the request server to screen out gaming machines that may not be of interest to a particular player. For example, a player may have placed the highest bid of all of the currently waiting players, but may have also specified a filter condition that indicates that the player only wishes to play a particular game. If a gaming machine is currently available but does not meet the filter condition, the request server may instead allocate the gaming machine to another player, e.g., one with the second-highest bid amount and filter conditions that do not preclude allocation of the gaming machine to that player. Any number of characteristics of gaming machines may be filtered in this way, e.g., including filtering by game type, game location, denominations that are playable, game style (poker-based slots, standard slots, etc.), CTRTP characteristic value, etc.

Figure 9:
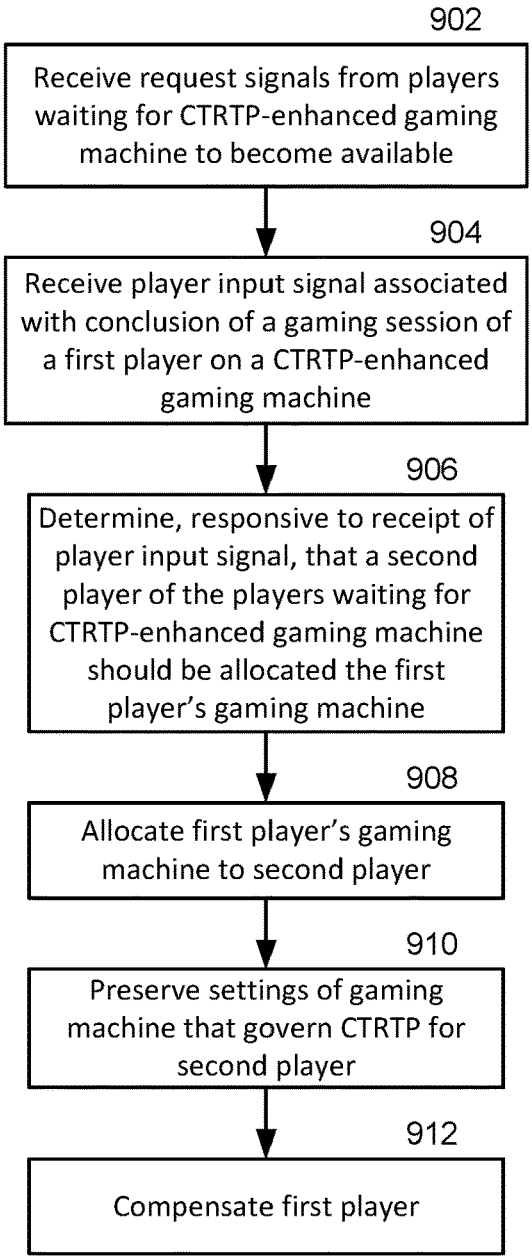
FIG. 9 depicts a block diagram of a general technique for transferring enhanced CTRTP characteristics from one player to a subsequent player.

FIG. 9 depicts a block diagram of a general technique for transferring enhanced CTRTP characteristics from one player to a subsequent player. In block 902, request signals may be received from one or more players that are waiting to "inherit" a CTRTP-enhanced gaming machine from a player who is nearly done playing on the gaming machine.

In block 904, a player input signal may be received that is associated with the conclusion of a gaming session by a first player on a CTRTP-enhanced gaming machine, i.e., one where the player has increased the CTRTP characteristic of the gaming machine. The player input signal may, for example, indicate that the first player is either done with their gaming session or will be finished with their gaming session soon.

In block 906, a determination may be made, based on the satisfaction of one or more transfer conditions, as to which of the players associated with the request signals should be allocated the first player's gaming machine. In block 908, the first player's gaming machine may be allocated to the second player identified in block 906, and in block 910, the settings of the gaming machine that govern CTRTP of the first player's gaming machine may be preserved for the second player. In some implementations, the enhanced CTRTP characteristic may actually be transferred between gaming machines instead of having the second player actually have to locate the first player's gaming machine and engage in play thereupon. For example, if the first player is on a first gaming machine and the second player is on a second gaming machine (which may, for example, be located elsewhere in the same casino, or even a different casino, from the first gaming machine), the settings that have been modified to produce the increased CTRTP characteristic of the first gaming machine may be re-created on the second player's gaming machine and may be reset on the first player's gaming machine as part of the allocation of the first player's enhanced CTRTP gaming machine to the second player.

In block 912, the first player may be compensated by the second player in some manner, as discussed earlier, for allowing the second player to take over the enhanced CTRTP gaming machine that the first player invested time in order to increase the CTRTP characteristic of the gaming machine.

In some instances, the CTRTP characteristic of a gaming machine may adjusted downwards somewhat prior to transfer to a new player. For example, if a first player increases a CTRTP characteristic of a gaming machine from 70.0% to 90.0% during a gaming session and the first gaming machine (or its settings), at the conclusion of the first player's gaming session, is then transferred to a second player, as discussed above, the CTRTP characteristic of the gaming machine may be adjusted downward by some amount prior to the transfer, e.g., only half of the increase may be passed on to the second player. In some implementations, the amount of the CTRTP increase from the first player that is transferred to the second player may be randomly determined. For example, a percentage of the CTRTP increase from the first player may be randomly determined and then applied to the total CTRTP increase that the first player accrued; this reduced portion of that CTRTP increase may then be passed on to the second player. This may help ensure that such gaming machines do not remain at a high or maximum permitted CTRTP characteristic value indefinitely. It is also to be understood that, in some implementations, the CTRTP characteristic of a gaming machine may also be periodically reduced for similar reasons. For example, in some instances, a gaming machine with enhanced CTRTP may be "reset" to its preenhanced state at the conclusion of a gaming session. In systems where a CTRTP-enhanced gaming machine may be passed on to a subsequent player, there may be limits put in place as to how many times such a gaming machine may be passed on to a subsequent player before being caused to have its CTRTP characteristics reset. For example, if a player inherits a CTRTP-enhanced gaming machine, as opposed to "cultivating" it from an initially non-enhanced state, such a gaming machine may be "reset" at the conclusion of the inheriting player's gaming session, whereas a player that cultivated a gaming machine to an enhanced CTRTP characteristic state from an initially non-enhanced state would be allowed to have that gaming machine allocated to a follow-on player at the conclusion of play.

It is to be understood that the phrase "for each <item>of the one or more <items>," if used herein, should be understood to be inclusive of both a single-item group and multiple-item groups, i.e., the phrase "for . . . each" is used in the sense that it is used in programming languages to refer to each item of whatever population of items is referenced. For example, if the population of items referenced is a single item, then "each" would refer to only that single item (despite the fact that dictionary definitions of "each" frequently define the term to refer to "every one of two or more things") and would not imply that there must be at least two of those items.

The use, if any, of ordinal indicators, e.g., (a), (b), (c) . . . or the like, in this disclosure and claims is to be understood as not conveying any particular order or sequence, except to the extent that such an order or sequence is explicitly indicated. For example, if there are three steps labeled (i), (ii), and (iii), it is to be understood that these steps may be performed in any order (or even concurrently, if not otherwise contraindicated) unless indicated otherwise. For example, if step (ii) involves the handling of an element that is created in step (i), then step (ii) may be viewed as happening at some point after step (i). Similarly, if step (i) involves the handling of an element that is created in step (ii), the reverse is to be understood.

Terms such as "about," "approximately," "substantially," "nominal," or the like, when used in reference to quantities or similar quantifiable properties, are to be understood to be inclusive of values within ±10% of the values or relationship specified (as well as inclusive of the actual values or relationship specified), unless otherwise indicated.

It should be appreciated that all combinations of the foregoing concepts (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

What is claimed is:

1. An electronic gaming system comprising:

one or more displays associated with a first gaming machine; and a game controller that includes one or more processors and one or more memory devices, wherein:

the one or more processors, the one or more memory devices, and the one or more displays are operably connected, and the one or more memory devices store computer-executable instructions for controlling the one or more processors to:

cause a game of chance to be displayed on the one or more displays of the first gaming machine that has a current theoretical return-to-player (CTRTP) characteristic that is defined by one or more settings associated with the first gaming machine;

cause credit wagers on the game of chance from a first player to be accepted;

cause an indicator of the CTRTP characteristic to be displayed on the one or more displays concurrently with the display of the game of chance on the one or more displays;

cause, during the game of chance, one or more notifications to be provided to the first player of the first gaming machine, each notification notifying the first player of a corresponding opportunity to increase the CTRTP characteristic of the first gaming machine, each opportunity to increase the CTRTP characteristic of the first gaming machine requiring satisfaction of a corresponding one or more CTRTP increase conditions associated with a credit wagering rate of the first player on the first gaming machine, wherein each notification to the first player includes an indication of an amount that the CTRTP characteristic will be increased by in association with the corresponding opportunity and an indication of what credit wagering rate-related actions specific to the game of chance the first player will need to perform while playing the game of chance in order to meet the one or more CTRTP increase conditions;

monitor the credit wagering rate of the first player of the first gaming machine while the first player is playing the game of chance;

adjust the one or more settings associated with the first gaming machine to increase the CTRTP characteristic each time the first player satisfies the one or more CTRTP increase conditions corresponding to one of the opportunities;

adjust, responsive to each increase of the CTRTP characteristic, the indicator of the CTRTP characteristic displayed on the one or more displays to indicate the increased CTRTP characteristic;

determine that a first gaming session of the first player has concluded;

determine that the one or more settings of the first gaming machine, and thus the CTRTP characteristic, are to be passed on to a second player; and cause, at least in part, the one or more settings of the first gaming machine, and thus the CTRTP, to be used in configuring the game of chance on a selected gaming machine, wherein the selected gaming machine is a gaming machine associated with the second player and is either the first gaming machine or another gaming machine.

2. The electronic gaming system of claim 1, wherein at least one of the opportunities to increase the CTRTP characteristic of the first gaming machine requires satisfaction of a corresponding CTRTP increase condition that is met when the first player reduces a credit wagering rate from a current credit wagering rate.

3. The electronic gaming system of claim 1, wherein at least one of the opportunities to increase the CTRTP characteristic of the first gaming machine requires satisfaction of a corresponding CTRTP increase condition that is met when the first player increases a credit wagering rate from a current credit wagering rate.

4. The electronic gaming system of claim 1, wherein the indication of the amount that the CTRTP characteristic will be increased by is an indication of a value that the CTRTP will be after the increase.

5. The electronic gaming system of claim 1, wherein the one or more memory devices further store computer-executable instructions for further controlling the one or more processors to:

periodically determine a session return-to-player (SRTP) for the first player for a first gaming session involving play of the game of chance by the first player; and cause an indicator of the SRTP to be displayed on the one or more displays during the display of the game of chance on the one or more displays.

6. The electronic gaming system of claim 1, further including a first automatic wagering sensor and a first rate selector that are also associated with the first gaming machine, wherein the one or more memory devices further store computer-executable instructions for further controlling the one or more processors to:

receive first data from the first automatic wagering sensor indicative of a condition external to the electronic gaming system;

receive second data from the first rate selector;

cause the first gaming machine to periodically wager credits in the game of chance at a first credit wagering rate while the first data from the first automatic wagering sensor meets a first automatic wagering condition; and modify the first credit wagering rate based on the second data.

7. The electronic gaming system of claim 6, wherein the first rate selector is configured to generate, responsive to user input, one or more signals selected from the group consisting of: a signal indicating a change in wagering frequency, a signal indicating a change in wager amount, and signals indicating a change in wagering frequency and a change in wager amount.

8. The electronic gaming system of claim 6, wherein the one or more memory devices further store computer-executable instructions for further controlling the one or more processors to:

cause graphical content to be displayed on the one or more displays showing progression through an environment along a substantially predefined path, wherein the path periodically includes branch points, each branch point having a plurality of branches and each branch associated with a corresponding selectable rate;

determine, for each branch point and in response to the second data, which branch of each branch point is indicated by the second data as being selected;

modify the first credit wagering rate based on the second data by modifying the first credit wagering rate based on the corresponding selectable rate for each branch that is indicated by the second data as being selected; and cause the graphical content displayed on the one or more displays to vary depending on which branch is indicated by the second data as being selected.

9. The electronic gaming system of claim 8, wherein the first rate selector includes an emergency brake feature and the one or more memory devices further store computer-executable instructions for further controlling the one or more processors to: reduce the first credit wagering rate responsive to the second data indicating that the emergency brake feature has been activated.

10. The electronic gaming system of claim 6, wherein the one or more memory devices further store computer-executable instructions for further controlling the one or more processors to:

cause graphical content to be displayed on the one or more displays showing a first-person point-of-view progression moving through an environment substantially along a path with a plurality of targets arranged substantially along the path, and cause the first-person point-of-view to move along an axis transverse to the path responsive to the second data during progression of the first-person point-of-view through the environment, wherein at least one of the one or more CTRTP increase conditions is satisfied when the first-person point-of-view is caused to move, responsive to the second data, such that the first-person point-of-view substantially aligns with a predetermined number of targets during progression of the first-person point-of-view through the environment.

11. The electronic gaming system of claim 6, wherein the one or more memory devices further store computer-executable instructions for further controlling the one or more processors to:

cause graphical content to be displayed on the one or more displays showing movement of a graphical depiction of an environment relative to the one or more displays, the environment containing a plurality of targets that are sequentially displayed on the one or more displays during the movement of the graphical depiction of the environment relative to the one or more displays;

cause a graphical object to be displayed on the one or more displays while the graphical content is displayed; and cause the graphical object to move along an axis transverse to a direction of movement of the graphical depiction responsive to the second data, wherein at least one of the one or more CTRTP increase conditions is satisfied when the graphical object is caused to move, responsive to the second data, such that the graphical object passes through a predetermined number of the targets during movement of the graphical depiction.

12. The electronic gaming system of claim 1, wherein the one or more memory devices further store computer-executable instructions for further controlling the one or more processors to:

receive one or more request signals, each request signal associated with a different player of a corresponding one or more other players different from the first player and including the second player;

determine that the first gaming session of the first player has concluded responsive to receipt of a player input signal associated with conclusion of the first gaming session of the first player on the first gaming machine;

determine, responsive to receiving the player input signal, that the second player satisfies one or more transfer conditions;

allocate, responsive to determining that the second player satisfies the one or more transfer conditions, the first gaming machine to the second player; and cause the one or more settings of the first gaming machine, and thus the CTRTP characteristic, to be preserved for the second player after conclusion of the first gaming session of the first player on the first gaming machine and in association with initiation of a second gaming session on the first gaming machine and associated with the second player.

13. The electronic gaming system of claim 12, wherein the one or more memory devices further store computer-executable instructions for further controlling the one or more processors to:

receive bidding information from each of the one more other players;

determine that the second player has a winning bid based on the bidding information; and determine that the one or more transfer conditions are satisfied, at least in part, by the determination that the second player has the winning bid.

14. The electronic gaming system of claim 12, wherein:

each request signal is associated with a corresponding timestamp; and the one or more transfer conditions are satisfied, at least in part, when the corresponding timestamps of the request signals indicate that the second player has been waiting the longest of the one or more other players to be allocated a gaming machine selected from the group consisting of the first gaming machine and one or more other gaming machines that each provide a game of chance that has a player-increasable CTRTP characteristic.

15. The electronic gaming system of claim 12, wherein:

the request signal associated with the second player is associated with one or more filter conditions specified by the second player, and the one or more memory devices further store computer-executable instructions for further controlling the one or more processors to determine that the first gaming machine meets the filter conditions prior to allocating the first gaming machine to the second player.

16. The electronic gaming system of claim 12, wherein:

the one or more transfer conditions are satisfied when input is received from the second player that indicates that the second player agrees to pay a specified amount of money or credits to the first player, and the one or more memory devices further store computer-executable instructions for further controlling the one or more processors to cause the specified amount of money or credits to be transferred to the first player from a source associated with the second player.

17. The electronic gaming system of claim 12, wherein:

the one or more transfer conditions are satisfied when input is received from the second player that indicates that the second player agrees to pay a specified portion of one or more winnings that the second player is awarded during the second gaming session, and the one or more memory devices further store computer-executable instructions for further controlling the one or more processors to cause the specified portion of the one or more winnings that the second player is awarded during the second gaming session to be transferred to the first player from a source associated with the second player.

18. The electronic gaming system of claim 1, wherein the one or more memory devices further store computer-executable instructions for further controlling the one or more processors to:

receive one or more request signals, each request signal associated with a different player of a corresponding one or more other players different from the first player, the one or more other players including the second player;

receive a player input signal associated with conclusion of the first gaming session of the first player on the first gaming machine;

determine, responsive to receiving the player input signal, that the second player of the one or more other players satisfies one or more transfer conditions; and cause, responsive at least in part to determining that the second player satisfies the one or more transfer conditions, the settings that produced the increased CTRTP to be transmitted from the first gaming machine after conclusion of the first gaming session of the first player on the first gaming machine for use on a second gaming machine associated with the second player and different from the first gaming machine.

19. A non-transitory, computer-readable medium storing machine-readable and executable instructions for controlling one or more processors of an electronic gaming system to cause the one or more processors of the electronic gaming system to:

cause a game of chance to be displayed on one or more displays of a first gaming machine that has a current theoretical return-to-player (CTRTP) characteristic that is defined by one or more settings associated with the first gaming machine;

cause credit wagers on the game of chance from a first player to be accepted;

cause an indicator of the CTRTP characteristic to be displayed on the one or more displays concurrently with the display of the game of chance on the one or more displays;

cause, during the game of chance, one or more notifications to be provided to the first player of the first gaming machine, each notification notifying the first player of a corresponding opportunity to increase the CTRTP characteristic of the first gaming machine, each opportunity to increase the CTRTP characteristic of the first gaming machine requiring satisfaction of a corresponding one or more CTRTP increase conditions associated with a credit wagering rate of the first player on the first gaming machine, wherein each notification to the first player includes an indication of an amount that the CTRTP characteristic will be increased by in association with the corresponding opportunity and an indication of what credit wagering rate-related actions specific to the game of chance the first player will need to perform while playing the game of chance in order to meet the one or more CTRTP increase conditions;

monitor the credit wagering rate of the first player of the first gaming machine while the first player is playing the game of chance;

adjust the one or more settings associated with the first gaming machine to increase the CTRTP characteristic each time the first player satisfies the one or more CTRTP increase conditions corresponding to one of the opportunities;

adjust, responsive to each increase of the CTRTP characteristic, the indicator of the CTRTP characteristic displayed on the one or more displays to indicate the increased CTRTP characteristic;

determine that a first gaming session of the first player has concluded;

determine that the one or more settings of the first gaming machine, and thus the CTRTP characteristic, are to be passed on to a second player; and cause, at least in part, the one or more settings of the first gaming machine, and thus the CTRTP, to be used in configuring the game of chance on a selected gaming machine, wherein the selected gaming machine is a gaming machine associated with the second player and is either the first gaming machine or another gaming machine.

20. A method, implemented using one or more processors of an electronic gaming system, the method comprising:

causing, by the one or more processors, a game of chance to be displayed on one or more displays of a first gaming machine that has a current theoretical return-to-player (CTRTP) characteristic that is defined by one or more settings associated with the first gaming machine;

causing, by the one or more processors, credit wagers on the game of chance from a first player to be accepted;

causing, by the one or more processors, an indicator of the CTRTP characteristic to be displayed on the one or more displays concurrently with the display of the game of chance on the one or more displays;

causing, by the one or more processors and during the game of chance, one or more notifications to be provided to the first player of the first gaming machine, each notification notifying the first player of a corresponding opportunity to increase the CTRTP characteristic of the first gaming machine, each opportunity to increase the CTRTP characteristic of the first gaming machine requiring satisfaction of a corresponding one or more CTRTP increase conditions associated with a credit wagering rate of the first player on the first gaming machine, wherein each notification to the first player includes an indication of an amount that the CTRTP characteristic will be increased by in association with the corresponding opportunity and an indication of what credit wagering rate-related actions specific to the game of chance the first player will need to perform while playing the game of chance in order to meet the one or more CTRTP increase conditions;

monitoring, by the one or more processors, the credit wagering rate of the first player of the first gaming machine while the first player is playing the game of chance;

adjusting, by the one or more processors, the one or more settings associated with the first gaming machine to increase the CTRTP characteristic each time the first player satisfies the one or more CTRTP increase conditions corresponding to one of the opportunities;

adjusting, by the one or more processors and responsive to each increase of the CTRTP characteristic, the indicator of the CTRTP characteristic displayed on the one or more displays to indicate the increased CTRTP characteristic;

determining, by the one or more processors, that a first gaming session of the first player has concluded;

determining, by the one or more processors, that the one or more settings of the first gaming machine, and thus the CTRTP characteristic, are to be passed on to a second player; and causing, by the one or more processors and at least in part, the one or more settings of the first gaming machine, and thus the CTRTP, to be used in configuring the game of chance on a selected gaming machine, wherein the selected gaming machine is a gaming machine associated with the second player and is either the first gaming machine or another gaming machine.

* * * * *